US011029095B2

(12) United States Patent
Penny et al.

(10) Patent No.: US 11,029,095 B2
(45) Date of Patent: Jun. 8, 2021

(54) FINNED COAXIAL COOLER

(71) Applicant: Senior UK Limited, Gwent (GB)

(72) Inventors: Charles Penny, Ross-on-Wye (GB); Adrian Ware, Ross-on-Wye (GB); Ragu Subramanyam, Gwent (GB)

(73) Assignee: Senior UK Limited, Crumlin (GB)

( * ) Notice: Subject to any disclaimer, the term of this patent is extended or adjusted under 35 U.S.C. 154(b) by 307 days.

(21) Appl. No.: 15/211,609

(22) Filed: Jul. 15, 2016

(65) Prior Publication Data

US 2017/0030652 A1 Feb. 2, 2017

(30) Foreign Application Priority Data

Jul. 30, 2015 (GB) ..... 1513415
Aug. 27, 2015 (EP) ..... 15002537

(51) Int. Cl.

| | |
|---|---|
| ***F28D 7/10*** | (2006.01) |
| ***F28D 7/14*** | (2006.01) |
| ***F28D 21/00*** | (2006.01) |
| ***F02M 26/32*** | (2016.01) |
| ***F28F 1/08*** | (2006.01) |

(Continued)

(52) U.S. Cl.

CPC ..... *F28D 7/106* (2013.01); *F02M 26/32* (2016.02); *F28D 7/14* (2013.01); *F28D 21/0003* (2013.01); *F28F 1/08* (2013.01); *F28F 1/426* (2013.01); *F28F 13/12* (2013.01); *F28D 2021/0026* (2013.01); *F28F 2265/26* (2013.01)

(58) Field of Classification Search

CPC ..... F28D 7/106; F28D 21/0003; F28D 7/14; F28D 2021/0026; F28F 13/12; F28F 1/426; F28F 2265/26; F28F 1/06; F28F 1/003; F28F 1/02; F02M 26/32

See application file for complete search history.

(56) References Cited

U.S. PATENT DOCUMENTS 813,918 A * 2/1906 Schmitz ..... F28D 7/103 122/367.2
1,005,441 A * 10/1911 Lovekin ..... F28D 7/106 122/257

(Continued)

FOREIGN PATENT DOCUMENTS

| | | |
|---|---|---|
| AU | 1621370 | 12/1971 |
| CN | 2869738 | 2/2007 |

(Continued)

OTHER PUBLICATIONS

European Search Report issued on EP15002537.7, completed Jan. 9, 2017, 2 pages.

(Continued)

*Primary Examiner* — Ljiljana V. Ciric
(74) *Attorney, Agent, or Firm* — Greenberg Traurig, LLP

(57) ABSTRACT

A heat exchanger (100) for an exhaust gas recirculation system includes one or more rigid tubes (103), each having one or more internal cooling fins (111) that act as heat exchange surfaces to transfer heat from a gas to the walls of the rigid tubes. The rigid tubes are cooled by a liquid coolant contained within an outer jacket (113) surrounding the tubes. The rigid tubes may be straight and smooth, and may be alternated with one or more bellows sections (108, 104) which provide flexibility to the heat exchanger.

22 Claims, 12 Drawing Sheets

(51) Int. Cl.
*F28F 1/42* (2006.01)
*F28F 13/12* (2006.01)

(56) References Cited

U.S. PATENT DOCUMENTS 1,024,436 A * 4/1912 Cartault ..... F28D 7/106 122/367.2
1,246,583 A * 11/1917 Fulweiler ..... F28F 13/12 138/38
1,400,179 A * 12/1921 Pfeiffer ..... F28D 7/103 165/141
1,529,190 A * 3/1925 Kettering ..... F25B 39/04 165/155
1,744,074 A * 1/1930 Gortner ..... F28F 1/36 165/184
1,838,105 A * 12/1931 Murray ..... F22G 7/065 122/367.3
1,881,771 A * 10/1932 Lyman ..... F28F 1/42 165/155
1,929,540 A * 10/1933 Trane ..... F28F 1/20 165/183
1,960,305 A * 5/1934 Emmons ..... F28D 1/053 165/184
2,079,144 A * 5/1937 Appa ..... F28F 13/12 138/38
2,197,243 A * 4/1940 Moran ..... F28B 1/02 138/38
2,220,726 A * 11/1940 Newcum ..... F25B 40/00 165/179
2,259,433 A * 10/1941 Kitto ..... B21D 53/06 138/113
2,308,319 A * 1/1943 Stanton ..... B23K 1/0012 165/184
2,372,795 A * 4/1945 Rodeck ..... F28F 1/36 29/890.048
2,386,159 A * 10/1945 Elder ..... F28F 13/12 138/38
2,662,749 A * 12/1953 Buschow ..... F28D 7/103 165/141
2,703,921 A * 3/1955 Brown, Jr. ..... F28F 1/42 29/890.036
2,712,438 A * 7/1955 Brown, Jr. ..... F28D 7/10 126/118
2,731,709 A * 1/1956 Gaddis ..... B21C 37/225 138/38
2,756,032 A * 7/1956 Dowell ..... F28D 21/0008 138/114
2,778,610 A * 1/1957 Bruegger ..... B01J 15/005 122/4 D
2,870,999 A * 1/1959 Soderstrom ..... F28F 1/36 165/184
2,929,408 A * 3/1960 Smith ..... F28F 1/40 138/115
2,960,114 A * 11/1960 Hinde ..... F28F 1/06 138/38
3,000,495 A * 9/1961 Downing ..... B65D 75/40 138/114
3,033,651 A * 5/1962 Latham, Jr. ..... C09C 1/50 422/156
3,083,662 A * 4/1963 Zeidler ..... B21D 53/02 138/38
3,104,735 A * 9/1963 Ludlow ..... F01N 1/02 138/37
3,120,868 A * 2/1964 Ballantine ..... F28D 7/103 165/155
3,158,122 A * 11/1964 De Give ..... B21D 53/08 29/890.036
3,177,936 A * 4/1965 Gustave ..... F28F 1/06 138/40
3,197,975 A * 8/1965 Boling ..... F24F 5/001 165/154
3,200,848 A * 8/1965 Takagi ..... F28F 1/105 138/38
3,259,206 A * 7/1966 Straw ..... F01N 1/026 138/44
3,323,586 A * 6/1967 Burne ..... F28F 13/003 165/154
3,332,446 A * 7/1967 Mann ..... F16L 59/125 138/114
3,339,260 A * 9/1967 Burne ..... B21D 53/06 165/154
3,397,440 A * 8/1968 Dalin ..... F28F 1/122 29/890.048
3,412,787 A * 11/1968 Muligan ..... F28D 9/04 165/150
3,455,379 A * 7/1969 Habdas ..... F28F 1/36 165/184
3,468,371 A * 9/1969 Menze ..... B21D 53/02 165/156
3,474,513 A * 10/1969 Allingham ..... B21D 53/08 29/890.036
3,482,626 A * 12/1969 Weisberg ..... F28D 7/1669 165/141
3,550,235 A * 12/1970 Boose ..... B23K 11/084 29/890.048
3,595,299 A * 7/1971 Weishaupt ..... F17C 9/02 138/38
3,730,229 A * 5/1973 D'Onofrio ..... B21D 11/14 138/114
3,732,921 A * 5/1973 Hilicki ..... F28D 7/106 165/154
3,763,930 A * 10/1973 Frost ..... B21D 53/027 165/154
3,777,343 A * 12/1973 D'Onofrio ..... B21D 11/14 29/890.036
3,828,566 A * 8/1974 Wetzel ..... F25B 17/083 62/143
3,828,851 A * 8/1974 Takayasu ..... F28D 7/103 165/165
3,831,247 A * 8/1974 Degroote ..... B21D 53/08 165/154
3,864,937 A * 2/1975 Asher ..... F25B 33/00 62/496
3,887,004 A * 6/1975 Beck ..... F28F 1/42 165/179
3,902,552 A * 9/1975 McLain ..... B21C 37/0803 138/140
4,004,634 A * 1/1977 Habdas ..... F28D 7/106 165/141
4,059,882 A * 11/1977 Wunder ..... B21D 53/08 29/890.036
4,086,959 A * 5/1978 Habdas ..... F28F 1/42 165/141
4,090,559 A * 5/1978 Megerlin ..... F28F 1/40 165/179
4,096,616 A * 6/1978 Coffinberry ..... B21D 53/06 29/890.036
4,154,296 A * 5/1979 Fijas ..... F28F 1/32 138/38
4,163,474 A * 8/1979 MacDonald ..... B21C 37/225 138/103
4,184,544 A * 1/1980 Ullmer ..... F24B 7/005 165/184
4,194,560 A * 3/1980 Matsuzaki ..... F01P 11/08 165/141
4,254,081 A * 3/1981 Streczyn ..... A61M 1/322 422/46
4,284,133 A * 8/1981 Gianni ..... F28D 7/106 165/133
4,305,457 A * 12/1981 Cozzolino ..... F28F 1/105 165/154
4,306,619 A * 12/1981 Trojani ..... F28F 1/42 138/38
4,314,587 A * 2/1982 Hackett ..... F16L 9/02 138/137
4,326,582 A * 4/1982 Rosman ..... F28D 7/106 165/83
4,336,838 A * 6/1982 Ely ..... F28F 13/12 138/38

(56) References Cited

U.S. PATENT DOCUMENTS 4,345,644 A * 8/1982 Dankowski ..... F28D 1/0246 165/154
4,351,389 A * 9/1982 Guarnaschelli ..... F28F 1/34 165/141
4,352,378 A * 10/1982 Bergmann ..... F28F 13/12 138/38
4,372,374 A * 2/1983 Lee ..... F28D 7/103 165/154
4,373,578 A * 2/1983 Saperstein ..... F28F 9/0234 165/141
4,402,359 A * 9/1983 Carnavos ..... F28F 1/12 138/121
4,425,942 A * 1/1984 Hage ..... B21C 37/20 138/38
4,432,485 A * 2/1984 Smith ..... B23K 37/053 138/148
4,475,584 A * 10/1984 Martin ..... F28D 7/106 165/154
4,648,441 A * 3/1987 van de Sluys ..... F25B 33/00 165/111
4,778,002 A * 10/1988 Allgauer ..... F16N 39/02 165/141
4,794,983 A * 1/1989 Yoshida ..... F28D 15/046 165/133
4,844,153 A * 7/1989 Mellsjo ..... F28D 7/026 165/174
4,862,955 A * 9/1989 Itakura ..... F28D 7/103 165/155
4,869,230 A * 9/1989 Fletcher ..... F23C 3/002 126/91 A
4,893,670 A * 1/1990 Joshi ..... F01P 11/08 123/196 AB
4,899,812 A * 2/1990 Altoz ..... B01F 5/0616 138/38
4,924,838 A * 5/1990 McCandless ..... F02B 37/00 123/514
4,938,036 A * 7/1990 Hodgkins ..... F02M 31/20 123/541
4,964,459 A * 10/1990 Stenlund ..... F28D 7/106 123/41.33
4,986,349 A * 1/1991 Ono ..... F28D 7/103 165/154
4,991,643 A * 2/1991 Price ..... F28F 27/02 165/101
4,995,454 A * 2/1991 Thompson ..... F28D 7/106 165/154
4,996,029 A * 2/1991 Martin ..... B01J 8/0278 165/154
5,031,694 A * 7/1991 Lloyd ..... F28F 1/12 165/146
5,050,668 A * 9/1991 Peterson ..... F02C 7/08 165/81
5,062,474 A * 11/1991 Joshi ..... F28D 1/0333 165/109.1
5,098,514 A * 3/1992 Held ..... B30B 15/064 156/583.1
5,107,922 A * 4/1992 So ..... F28F 1/105 165/109.1
5,167,275 A * 12/1992 Stokes ..... F28F 13/12 165/109.1
5,181,560 A * 1/1993 Burn ..... F28F 1/42 122/510
5,215,144 A * 6/1993 May ..... F28D 21/0008 165/154
5,251,603 A * 10/1993 Watanabe ..... F02M 31/20 123/541
5,337,807 A * 8/1994 Ryan ..... F28F 1/36 165/146
5,341,769 A * 8/1994 Ueno ..... F17C 9/02 122/367.3
5,375,654 A * 12/1994 Hougland ..... F28F 13/12 138/38
5,429,112 A * 7/1995 Rozzi ..... F24D 5/08 126/104 A
5,497,824 A * 3/1996 Rouf ..... F28F 13/12 138/38
5,558,069 A * 9/1996 Stay ..... F02M 31/10 123/541
5,560,424 A * 10/1996 Ogawa ..... B21D 13/045 165/181
5,575,066 A * 11/1996 Cocchi ..... B23P 15/26 29/890.035
5,575,067 A * 11/1996 Custer ..... B28B 1/002 29/890.036
5,623,989 A * 4/1997 Kroger ..... F28F 1/32 165/152
5,625,229 A * 4/1997 Kojima ..... F28F 3/025 257/712
5,690,167 A * 11/1997 Rieger ..... B21C 37/207 165/133
5,732,769 A * 3/1998 Staffa ..... F28D 7/106 165/154
5,735,342 A * 4/1998 Nitta ..... F28D 7/106 165/121
RE35,890 E * 9/1998 So ..... F28F 1/105 165/109.1
5,950,716 A * 9/1999 Appelquist ..... F28D 7/106 165/109.1
6,009,908 A * 1/2000 Hartnagel ..... B60H 1/00342 138/109
6,019,168 A * 2/2000 Kinnersly ..... F28D 7/106 165/154
6,070,657 A * 6/2000 Kunkel ..... F24H 9/0026 138/157
6,085,738 A * 7/2000 Robinson ..... F23D 11/00 122/17.2
6,095,236 A * 8/2000 Kuhler ..... F28F 1/105 165/80.1
6,098,704 A * 8/2000 Tsuchiya ..... B21C 23/10 165/154
6,131,615 A * 10/2000 Hartnagel ..... B60H 1/00342 138/109
6,220,344 B1 * 4/2001 Beykirch ..... F28D 7/022 165/154
6,244,196 B1 * 6/2001 Kimberlin ..... F23G 5/34 110/317
6,253,573 B1 * 7/2001 Schwitters ..... A23G 9/22 165/155
6,283,159 B1 * 9/2001 Tada ..... F16L 9/18 138/111
6,404,637 B2 * 6/2002 Hutchison ..... H04Q 1/10 165/185
6,438,936 B1 * 8/2002 Ryan ..... F02C 7/10 165/166
6,533,030 B2 * 3/2003 Mitrovic ..... F28F 1/40 138/38
6,557,626 B1 * 5/2003 O'Sullivan ..... H01L 23/467 165/121
6,585,034 B2 * 7/2003 Oswald ..... F23L 15/04 165/10
6,672,377 B2 * 1/2004 Liu ..... F28D 7/106 165/154
6,675,746 B2 * 1/2004 Gerstmann ..... F22B 7/00 122/136 C
6,729,388 B2 * 5/2004 Emrich ..... F02B 29/0456 165/109.1
6,904,961 B2 * 6/2005 Ayres ..... F28D 9/0037 165/133
6,920,917 B2 * 7/2005 Inoue ..... F28D 7/106 165/154
6,944,394 B2 * 9/2005 Long ..... F24H 1/102 392/465
6,990,806 B1 * 1/2006 Kinsel ..... F01N 3/02 60/313
6,997,246 B2 * 2/2006 Visser ..... F28F 1/40 165/109.1
7,044,210 B2 * 5/2006 Usui ..... F28D 7/1607 138/177

(56) References Cited

U.S. PATENT DOCUMENTS 7,063,131 B2 * 6/2006 Northrop ..... F28F 1/24 165/133
7,191,824 B2 * 3/2007 Wu ..... F28F 13/12 165/141
7,225,859 B2 * 6/2007 Mochizuki ..... F02G 1/055 165/10
7,293,603 B2 * 11/2007 Cox ..... F28D 7/026 165/156
7,303,002 B2 * 12/2007 Usui ..... F28D 7/1684 165/109.1
7,322,403 B2 * 1/2008 Agee ..... F28D 7/0041 165/109.1
7,438,122 B2 * 10/2008 Hawranek ..... F28D 1/0233 165/157
7,458,222 B2 * 12/2008 Orr ..... F28D 7/024 165/101
7,614,443 B2 * 11/2009 Usui ..... F28D 7/1684 165/177
7,770,602 B2 * 8/2010 Buschhoff ..... F16L 9/18 138/108
7,845,338 B2 * 12/2010 Smith ..... F28D 7/1669 123/568.12
7,866,378 B2 * 1/2011 Nakamura ..... F28F 1/426 165/156
8,047,451 B2 * 11/2011 McNaughton ..... B60S 1/487 237/12.3 B
8,047,686 B2 * 11/2011 Dahm ..... F21K 9/68 362/294
8,122,856 B2 * 2/2012 Franke ..... F22B 37/18 122/235.17
8,162,040 B2 * 4/2012 Briselden ..... F23C 3/002 165/109.1
8,171,985 B2 * 5/2012 Valensa ..... F22B 1/1807 165/154
8,261,816 B2 * 9/2012 Ambros ..... F02B 29/0462 165/158
8,425,656 B2 * 4/2013 Ciora, Jr. ..... F28F 1/405 95/43
8,474,515 B2 * 7/2013 Burgers ..... F28D 9/0018 165/109.1
8,516,699 B2 * 8/2013 Grippe ..... F28F 13/08 29/890.03
8,550,147 B2 * 10/2013 Lansinger ..... B60H 1/00271 165/141
8,590,604 B2 * 11/2013 Higashiyama ..... B21D 53/06 165/141
8,729,751 B2 * 5/2014 Telakowski ..... H02K 1/32 310/61
9,091,487 B2 * 7/2015 Byon ..... F28D 7/106
9,097,470 B2 * 8/2015 Chen ..... F28F 13/04
9,395,121 B2 * 7/2016 Meshenky ..... B21D 13/08
9,459,052 B2 * 10/2016 Kinder ..... F28F 13/12
9,472,489 B2 * 10/2016 Nakamura ..... H01L 23/473
9,494,063 B2 * 11/2016 Dupmeier ..... F01K 23/065
9,664,451 B2 * 5/2017 Rockenfeller ..... F25B 27/007
9,791,074 B2 * 10/2017 Hoglund ..... B01J 8/067
9,897,387 B2 * 2/2018 Glass ..... F28D 7/0066
9,897,398 B2 * 2/2018 Jarmon ..... F28F 21/04
9,915,184 B2 * 3/2018 Han ..... F01N 5/025
9,939,211 B2 * 4/2018 Hoglund ..... F28F 3/046
9,945,322 B2 * 4/2018 Wood ..... F02G 1/055
9,982,954 B1 * 5/2018 Jarmon ..... F28D 7/103
10,557,671 B2 * 2/2020 Mironets ..... F28F 13/08
2003/0010480 A1 * 1/2003 Shibagaki ..... F28D 7/1684 165/158
2004/0007350 A1 * 1/2004 Wu ..... B01J 19/0013 165/156
2004/0050538 A1 * 3/2004 Sunder ..... F25J 5/002 165/133
2004/0178627 A1 * 9/2004 Takasaki ..... F16L 9/18 285/123.3
2005/0045315 A1 * 3/2005 Seager ..... F28D 7/106 165/154
2005/0121179 A1 * 6/2005 Shibagaki ..... F28D 7/1684 165/153
2006/0096314 A1 * 5/2006 Nakamura ..... F16L 7/00 62/498
2007/0187067 A1 * 8/2007 Horiguchi ..... F28D 7/106 165/70
2009/0193804 A1 * 8/2009 Ohno ..... F28F 13/18 60/516
2009/0260586 A1 * 10/2009 Geskes ..... F02M 26/22 123/41.48
2010/0043415 A1 * 2/2010 Capelle ..... F28D 7/106 60/320
2011/0036544 A1 * 2/2011 Shirai ..... E03D 9/08 165/95
2011/0099973 A1 * 5/2011 Smith ..... F28F 27/02 60/273
2011/0168369 A1 * 7/2011 Kim ..... F28D 7/106 165/154
2011/0174412 A1 * 7/2011 Jebasinski ..... F01N 3/28 138/145
2013/0089413 A1 4/2013 Fujimoto et al.
2013/0192804 A1 * 8/2013 Matsuda ..... F28D 7/10 165/154
2015/0159957 A1 * 6/2015 Baxi ..... F28F 13/12 165/109.1
2015/0300757 A1 * 10/2015 Yang ..... F28F 9/167 165/149
2019/0353427 A1 * 11/2019 Johnson ..... F28F 13/12

FOREIGN PATENT DOCUMENTS

CN 103742298 4/2014
CN 106197120 A 12/2016
EP 1096131 A1 5/2001
EP 1388720 A2 2/2004
JP H10170172 A 6/1998
JP H11108578 4/1999
JP 2000111277 A 4/2000
JP 2001227413 8/2001
JP 2002054511 2/2002
JP 2010078233 A 4/2010

OTHER PUBLICATIONS

European Search Opinion issued on EP15062537.7, completed Jan. 9, 2017, 2 pages.
Intellectual Property Office, Office Action issued in Application No. GB1701501.7, dated Jun. 28, 2019, 5 pgs.
Intellectual Property Office, Office Action issued in Application No. GB1903719.1, dated Jun. 28, 2019, 8 pgs.
United States Patent and Trademark Office, Non-Final Office Action issued in U.S. Appl. No. 15/419,758, Notification dated Apr. 6, 2020, 11 pgs.

* cited by examiner

FINNED COAXIAL COOLER

RELATED APPLICATION INFORMATION

This application claims priority to and the benefit of United Kingdom Application No. 1513415.8, filed on Jul. 30, 2015 and European Application No. 15002537.7, filed on Aug. 27, 2015, the entire disclosure of each is incorporated herein by reference.

FIELD OF THE INVENTION

The present invention relates to heat exchangers.

BACKGROUND OF THE INVENTION

Modern internal combustion engines often use externally flowed and cooled exhaust gas recirculation (EGR) to aid emissions control and reduce fuel consumption. Modern gasoline and diesel engines can have high gas inlet temperatures into an exhaust gas recirculation system. These high gas temperatures can cause damage to EGR components for example the EGR valve or the main cooler.

It can be of significant advantage to reduce the exhaust gas recirculation gas temperature prior to contact with these potentially vulnerable components. A coaxial cooler is a component which can fulfill this function.

A coaxial cooler which is known in the art comprises a heat transfer tube positioned inside an outer tube. The heat transfer tube has a formed or corrugated surface which encourages heat exchange and gives some flexibility to the component.

Three major drawbacks of this type of prior art design are:

A relatively low heat exchange per unit length;

A relatively high gas pressure loss caused by the turbulence induced by the corrugation; and A relatively poor flow of coolant into the roots of the outside of the heat exchange tube.

A pre cooler located upstream in the gas flow to a valve or main cooler in an EGR system needs to be compact and of the shortest possible length since space is at a premium in modern vehicle engine compartments.

On EGR systems in particular, a low gas pressure drop in the return gas path between exhaust and engine air intake is critical for engine function. As an ongoing objective, engineers are always looking to reduce pressure losses in EGR systems, as this allows a greater flow for the same differential pressure.

Further, boiling of coolant can cause damage to components, coolers, pre coolers or even damage to the engine itself.

A problem with prior art co-axial heat exchange tubes of the corrugated type having an inner heat exchange tube and an outer corrugated housing with a liquid filled cavity therebetween is that the rate of heat exchange per unit length of the heat exchanger is insufficient in some EGR applications.

Further, with the known corrugated heat exchanger, excessive boiling of coolant can occur.

There is a need for a compact coaxial cooler which has a high ratio of heat exchange per unit length to transfer more energy to the coolant with reduced EGR gas pressure drop whilst at the same time avoiding damaging levels of boiling within the cooler.

SUMMARY OF THE INVENTION

According to a first aspect of the present invention, there is provided a heat exchanger for cooling hot gas using a liquid coolant, the heat exchanger comprising:

a heat exchange tube for exchanging heat between the gas and the liquid coolant;

a tubular outer body surrounding at least part of the inner heat exchange tube;

wherein the gas flows through a passage in the heat exchange tube and the liquid coolant flows between the heat exchange tube and the tubular outer body; and one or a plurality of fins located inside the inner heat exchange tube, and contacting with an inner surface of the heat exchange tube.

The fins may act to increase heat exchange between the gas and the liquid coolant by transferring heat from the centre of the gas flow to the inner walls of the heat exchange tube, whilst not significantly increasing the gas pressure drop along the heat exchange tube.

Each fin may comprise an inwardly extending fin wall extending between an inner surface of the heat exchange tube and towards a main central axis of the heat exchanger.

A first plurality of fins may extend substantially radially inwardly towards a central axis of the heat exchanger to a longer radial distance than to each of a second plurality of fins, so as not to cause one fin to be in close proximity to another fin.

The main planes of the fin walls preferably extend in a direction parallel to the main axial length of a section of the cooler in which they are fitted. Preferably the main planes of the fin walls extend radially towards the main central length axis of the tube in which they are located so as to provide a plurality of individual gas passages surrounding a central gas passage having its centre coincident with a main central axis of the heat exchange tube, so that gas flows along the main central passage and along each of the individual gas passages surrounding the main central gas passage.

The heat exchange tube may consist of a number of substantially straight sections separated by a bent or curve section. At least one of substantially straight sections will be over least part of its length plain or smooth. At least one fin will be attached to the heat exchange over a length of the substantially straight plain section. Other straight sections may have a profiled surface that is used without a fin.

A straight section of the heat exchange tube may be plain over its full length and have at least one fin attached to it over the majority of the length.

A straight section may be a combination of a plain section with at least one fin attached and a section of profiled tube without a fin attached.

The profiled section may comprise helical or annular corrugations or individual forms that improve heat exchange where there is no fin.

A corrugated straight section may also be used to give the heat exchange tube some thermal or vibrational compliance.

The bent sections of the heat exchange tube do not have fins. The bent section may be plain, helically or annularly corrugated or have a profiled geometry to improve heat exchange.

The embodiments include a heat exchanger for cooling a hot gas using a liquid coolant, by utilising a coaxial cooler with an inner heat exchange tube and an outer body surrounding at least part of the inner heat exchange tube;

the hot gas flowing through the heat exchange tube and the coolant flowing in an annulus between the heat exchange tube and the outer body tube;

the heat exchange tube being smooth over at least part of its length, and having a fin or a series of fins joined to the inner surface of the heat exchange tube to increase heat exchange, whilst not significantly increasing gas pressure drop.

There may be fins having at least two different lengths, so as not to cause one fin to be in close proximity to another fin.

A plurality of fins are preferably formed from a single strip of material.

A plurality of fins may be arranged as a plurality of segments, each segment comprising at least one fin.

A plurality of fins may be manufactured from a strip of material such that the plurality of fins are formed into an arc of substantially less than 360°, when unconstrained and wherein the plurality of fins form an arc of nearly 360°, when constrained by insertion into a tube.

A plurality of fins may be manufactured from a single strip of material and may comprise a plurality of arcs wherein each arc has a radius greater than an internal radius of a tube into which the fin is designed to fit, so as to promote efficient heat transfer between the arcs of the fins and an internal surface of the tube. The tangent point of the radius of the corner of the fin may contact the heat exchange tube giving the shortest possible route for conduction of heat. When the fin is attached to the heat exchange tube with braze then the meniscus of the braze will further aid heat transfer by reducing the route for conduction and thickening the material width of the fin at its base.

The heat exchanger may comprise a compensation tube at one end of the heat exchanger to accommodate thermal growth and manufacturing tolerances.

The invention includes a gas to liquid heat exchanger comprising:

at least one tubular section having therein one or a plurality of heat exchange walls or fins extending into a gas passage of the tubular section, the walls extending along a main length of the tubular section; and an outer jacket surrounding at least a part of the at least one tubular section, there being a cavity between said tubular section and the outer jacket within which the liquid may pass.

The invention includes a heat exchanger for cooling hot gas using a liquid coolant, the heat exchanger comprising:

an inner heat exchange tube for exchanging heat between the gas and the liquid coolant;

a tubular outer body surrounding at least part of the inner heat exchange tube;

wherein the gas flows through the heat exchange tube and the liquid coolant flows between the inner heat exchange tube and the tubular outer body; and a fin member which fits inside the inner heat exchange member, the fin member comprising a plurality of substantially radially extending walls each extending along a main length direction of at least a portion of the inner heat exchange tube, and a plurality of substantially circumferentially extending connecting portions, each extending between adjacent ones of the substantially radially extending walls, and each connecting portion connecting a pair of the substantially radially extending walls;

wherein the fin member is of dimensions such as to fit tightly within the inner heat exchange tube such that an outer surface of each the connecting portion is in contact with an inner surface of the inner heat exchange tube.

Other aspects are as set out in the claims herein.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE EMBODIMENTS

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

In this specification, the embodiments described are heat exchangers aimed at exchanging heat between a gas and a liquid. In various embodiments, the heat exchangers described are coolers which cool a hot gas using a liquid coolant. It will be understood by the skilled person that a cooler is a type of heat exchanger.

The coolers described herein are particularly although not exclusively aimed at providing pre-cooling prior to a valve component in an internal combustion exhaust gas recirculation circuit. In this application, the cooler is fitted in an EGR circuit between an exhaust manifold and an exhaust gas recirculation valve or an EGR cooler, from which the recirculated gas is fed back into an inlet manifold of the internal combustion engine. However, in other applications, the cooler embodiments described herein may be suitable for long route circuit exhaust gas recirculation systems, in which an exhaust gas is sampled downstream of a catalytic converter and is reintroduced into an air inlet of an internal combustion engine upstream of the compressor.

Figure 1:
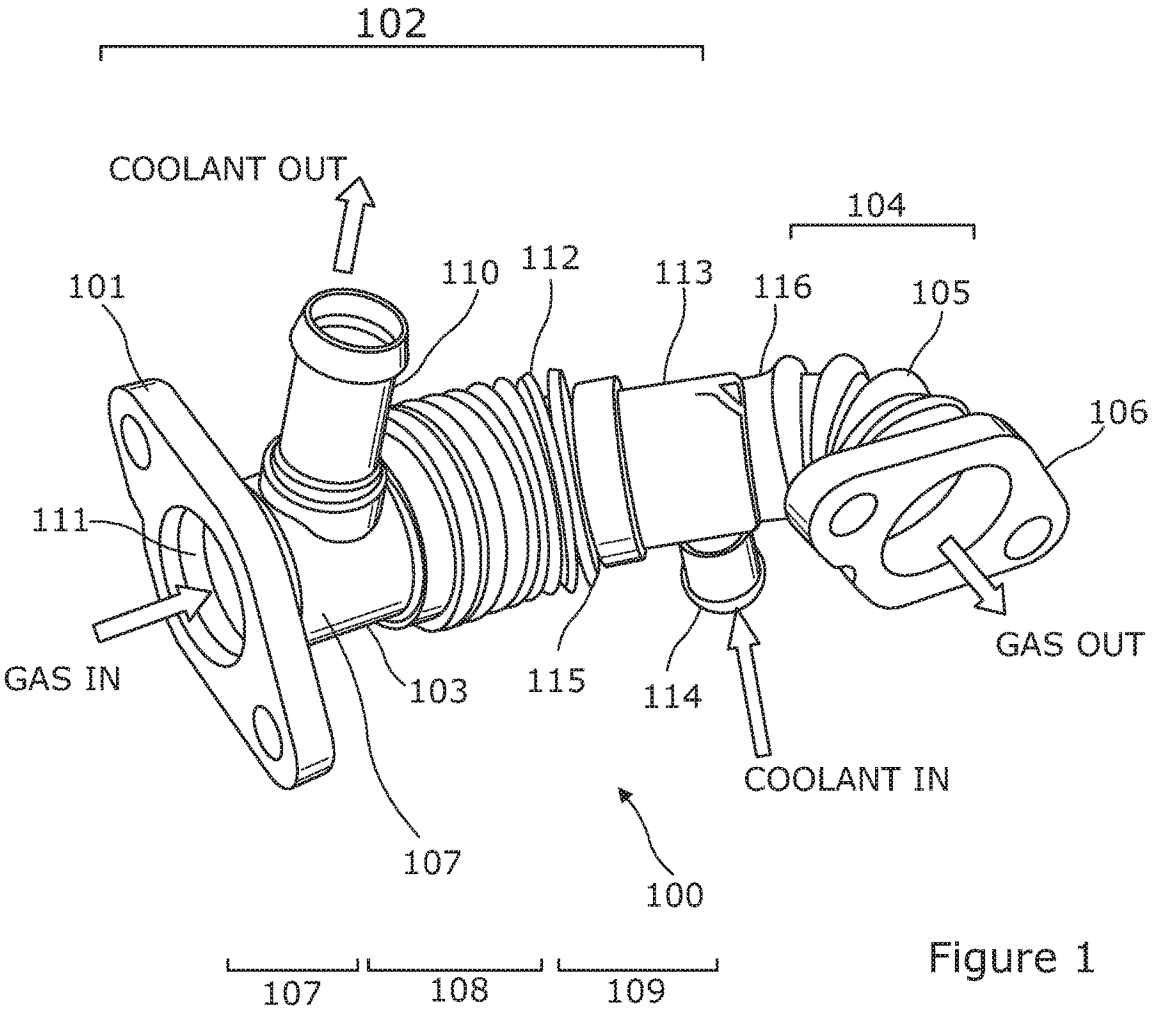
FIG. 1 shows schematically in perspective view a first cooler according to a first specific embodiment heat exchanger.

In the following description a flow of coolant is shown and described in a first direction as indicated by the arrows in FIG. 1 herein, but it will be appreciated that the coolant flow can be reversed so the coolant flows through the cooler in the opposite direction. Similarly, a gas flow direction is shown in a first direction in FIG. 1 herein, opposite to the general direction of coolant flow, but it will be appreciated that the direction of gas flow can be reversed. The cooler can be connected in a gas circuit so that the gas flow is either in the first gas flow direction of FIG. 1, or alternatively in the opposite direction. Similarly the coolant flow can be connected in the first coolant flow direction as shown in FIG. 1 herein, or alternatively in the opposite direction. The efficiency of heat transfer between gas and liquid coolant may be optimal when the gas and coolant flows are connected in opposite general directions to each other and as shown in FIG. 1 herein.

Figure 2:
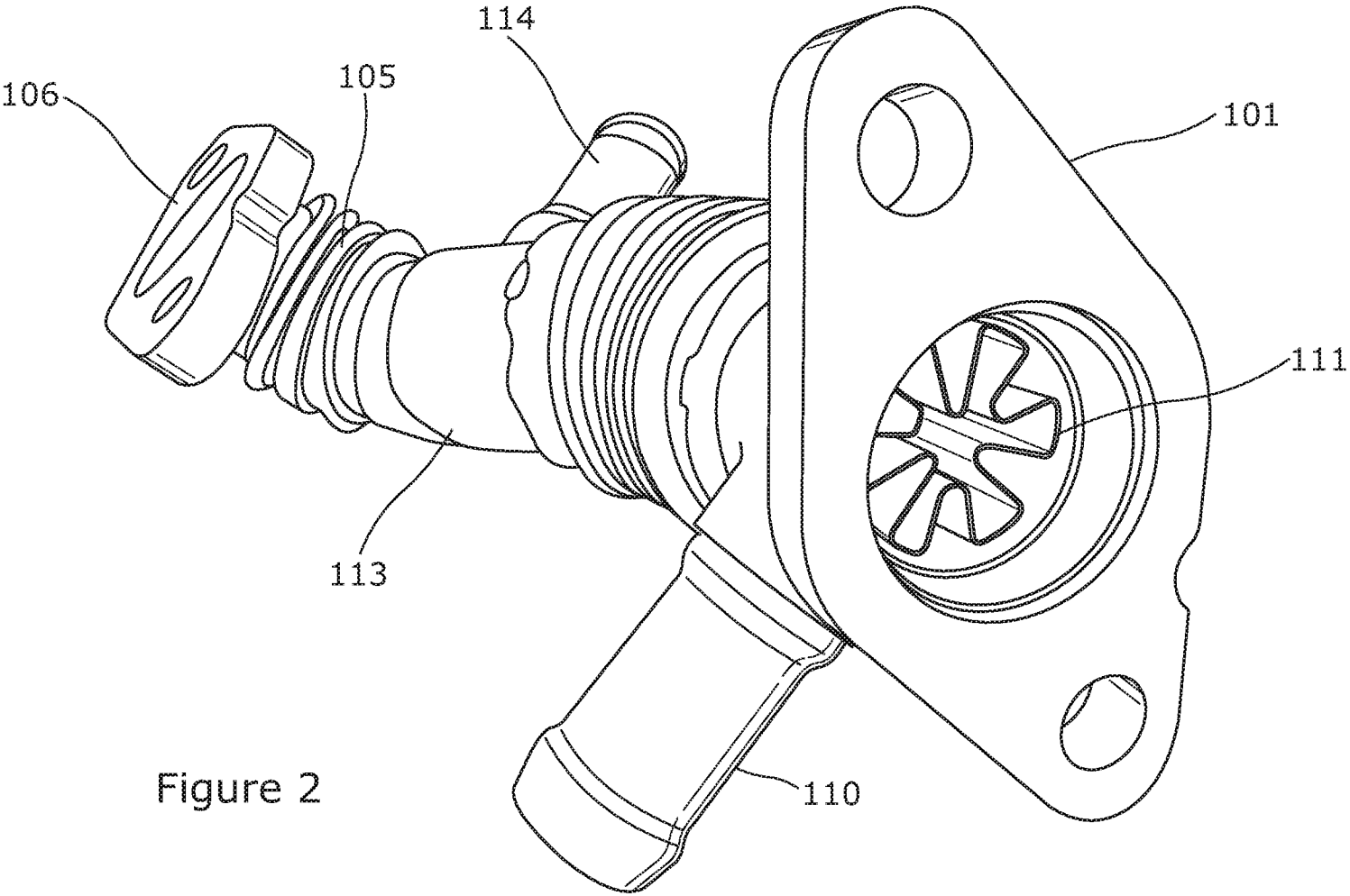
FIG. 2 shows the first cooler in perspective view from a first end.
Figure 3:
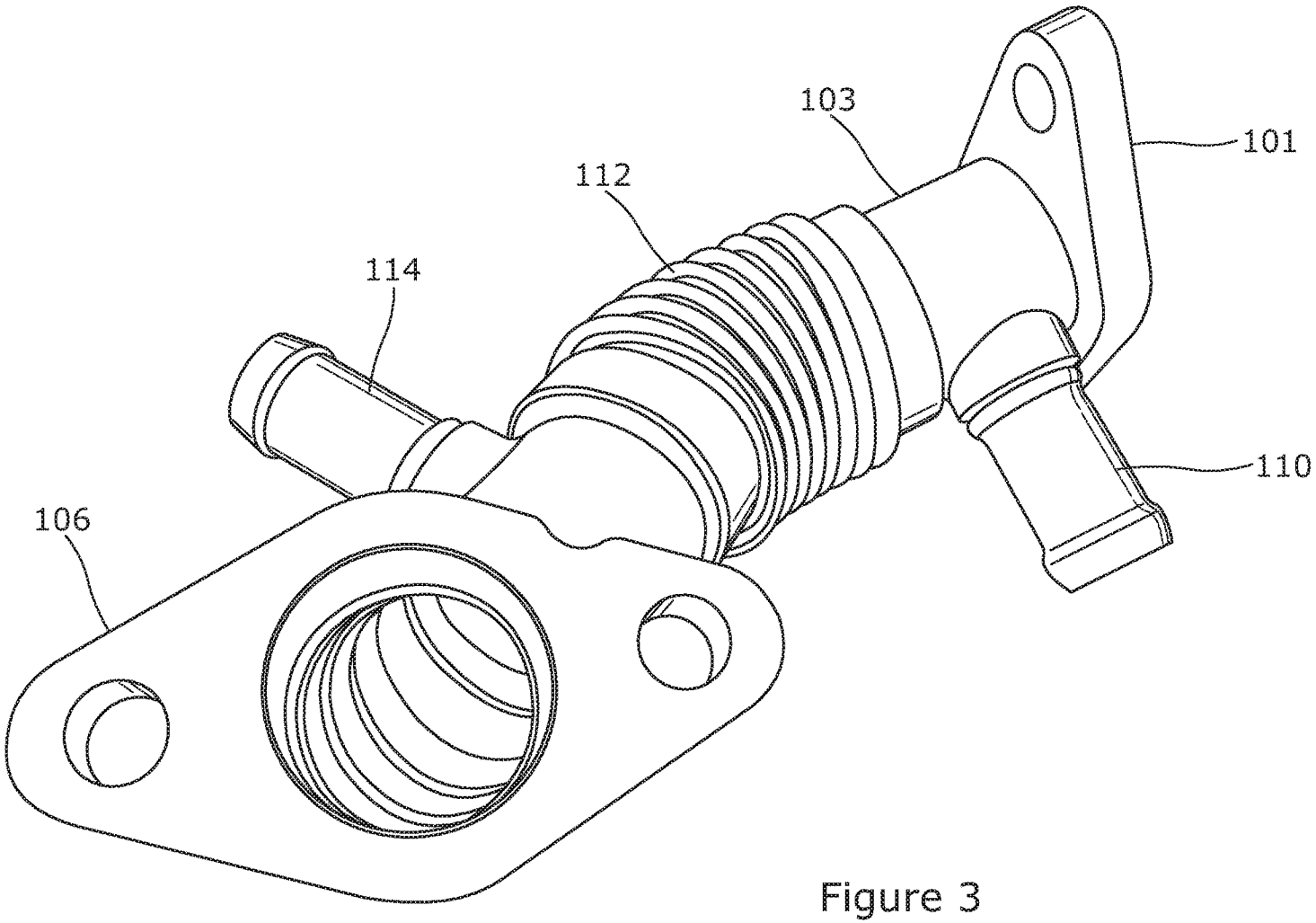
FIG. 3 herein shows the first cooler in perspective view from a second end.

In the embodiments described herein, a hot gas flow is shown as passing centrally through a liquid coolant flow, where the liquid coolant flow is contained within an outer jacket which surrounds a central heat exchange tube through which the gas passes, and the gas and liquid are separated by the thin metal walls of the heat exchange tube Referring to FIGS. 1 to 3 herein, there is shown three views of a co-axial cooler 100 according to a first specific embodiment. The cooler comprises a tubular gas passage for flow of gas therethrough, and a tubular outer jacket surrounding part of the length of the gas passage, there being a cavity between the inner tubular gas passage and the outer jacket, so that a liquid coolant can flow in the cavity between the inner tubular gas passage and the outer jacket, to cool part of the inner tubular gas passage. At one end of the cooler, there is a further connecting section 104 which is single walled and does not have an outer jacket, which is cooled by external ambient air.

One use of the cooler is to cool the exhaust gas flow immediately prior to entering the exhaust gas recirculation valve component. In use, the cooler component is fixed in an exhaust gas recirculation circuit of an internal combustion engine by connecting first and second ends of the cooler within the circuit. The cooler is inserted between an exhaust manifold of the internal combustion engine, and an exhaust gas recirculation valve.

The cooler 100 comprises: at a first end, a first flange 101 for connecting the first end of the cooler into a gas flow circuit; a liquid cooled section 102 having an inner tubular passage and an outer tubular jacket 103 in which a liquid coolant passes between the inner tubular passage and the outer tubular jacket in order to cool the inner tubular passage; an air cooled section 104 comprising a tubular bellows member 105; and at a second end of the cooler, a second flange 106 for connecting a second end of the cooler into said gas flow circuit.

The liquid cooled section outer coolant jacket 102 comprises a first straight substantially circular cylindrical section 107; a flexible corrugated central section 108 that has a straight and a bent portion; and a second straight substantially circular cylindrical section 109.

The first straight section 107 comprises a first outer substantially circular cylindrical tube 103; and a first inner substantially circular cylindrical tube. Extending transverse to the main axial length of the first section is provided a coolant outlet tube 110 for draining coolant from the first tubular section. A first end of the first outer tube is secured to the first flange 101 by welding or brazing the end of the outer tube to the flange at a position surrounding a circular aperture in the flange, and a first end of the first inner tube is also secured to the first outer tube 103 by welding or brazing to the inside of said circular aperture in the end of the flange, so that the inner and outer first tubes are coaxial with each other and have a substantially annular cavity therebetween. Liquid coolant enters the annular cavity at a second end of the straight section where the straight section joins with the flexible corrugated central section 108, and can pass through the annular cavity between the inside of the first outer tube and the outer surface of the first inner tube and can flow out of the coolant outlet tube 110.

Within the first straight inner tube there is provided a first finned insert member 111 which separates the interior of the first straight inner tube into a plurality of radially extending gas passages extending along a length of the first straight section.

The flexible corrugated central section 108 comprises a first outer corrugated tubular bellows member 112, the inner tube member being inside and concentric with the outer bellows member so that there is a cavity therebetween which completely surrounds the inner member and through which liquid coolant can flow. The corrugated central section 108 is sufficiently flexible to absorb thermal growth of the inner member during use of the cooler. A first end of the central corrugated section 108 is fixed to the second end of the first straight section 107, and a second end of the central corrugated section is attached to a first end of the second straight section 109.

The second straight section 109 comprises a second outer substantially circular cylindrical tube 113; a second inner substantially circular cylindrical tube located coaxially within the second outer cylindrical tube 113; and a coolant inlet tube 114 through which coolant can be passed into the second straight section 109. The inner heat exchange tube has a finned section that is not visible. A first end 115 of the second straight section 109 is fixed to a second end of the central corrugated section 108 and a second end 116 of the second straight section 109 is connected to a first end of the second section 104. The corrugated section 108 has the second ends of its respective inner and outer corrugated tubes connected in gas and liquid tight manner to the corresponding respective first ends of the second straight inner and outer tubes. The second ends 116 of the second inner and outer tubes are welded or brazed together so that the two tubes are located coaxially with each other and with an annular cavity there between through which liquid coolant passes.

Inside the inner tube of the second straight section 109 there is provided a second finned member which separates the interior of the second straight inner tube into a plurality of radially extending gas passages extending along a length of the second straight section, similarly to the first finned member 111 in the first straight section 107.

Within the first and second straight portions 107, 109, there is provided said first and second finned members, however the bent section of the central corrugated section 108 does not contain an internal finned member. The corrugated section 108 has a degree of thermal compliance due to the outer corrugated bellows part which is capable of absorbing thermal growth during operation of the cooler.

The air cooled section 104 is primarily aimed at providing a compensation portion to absorb differences in manufacturing tolerances, vibration and thermal growth of the cooled section 102. The gas cooled section 104 comprises a single wall corrugated bellows member 105, a first end of which is connected to a second end of the second straight section 109, and a second end of which is connected to the second flange member 106. The second section 104 has a degree of flexibility due to the corrugated bellows part 105 which is capable of absorbing vibration and thermal growth during operation of the cooler.

The cooler heat exchange tube therefore comprises alternating straight sections and bent sections along its length, wherein the straight sections have internal finned structures providing heat transfer surfaces which are aligned in an axial direction along the flow of gas.

In a variation, the second section 104 may be deleted and instead a corrugated bend and short length of straight on the heat exchange tube may be used. This, together with the corrugated outer tube give a component capable of absorbing build tolerances, vibration and thermal growth.

Referring to FIG. 2 herein, there is shown the first end of the cooler in which the first finned structure 111 can be seen inserted into the inner tube of the first straight section. The first finned structure comprises a tubular metal component having in the radial direction a plurality of flower petal shaped undulations, so that a single central passage of the fin component presents a substantially flower shape central gas passage as viewed in the main direction of gas flow surrounded by a plurality of substantially triangular or trapazoid shaped peripheral gas passages between the fin member and the internal wall of the heat exchange tube. The finned component is inserted into the inner straight tube, so that between the fin component and the inner wall of the inner tube there are created a plurality of outer gas passages separated circumferentially from each other by the fin component, the outer passages separated from the central inner passage by the walls of the fin component. The walls of the fin component extend axially along the length of the straight section to present a first plurality of heat transfer walls which are radial to the straight section, and which are substantially parallel to the axial gas flow, and a second set of circumferential heat transfer walls which are concentric with and in contact with the inner cylindrical wall of the inner tube, and which extend axially along the length of the inner tube, one side of each said circumferential wall being in contact with the gas flow and another side of each said circumferential wall being in contact with the inner wall of the inner tube.

Referring to FIG. 3 herein, there is shown the cooler in perspective view from the second end, showing the inside of the single walled corrugated tube 105 of the end section 104. Inside the second straight section 109, there is a corresponding finned member similar to the finned member 111 in the first-rate section, which is just out of view in the view of FIG. 3.

Figure 4:
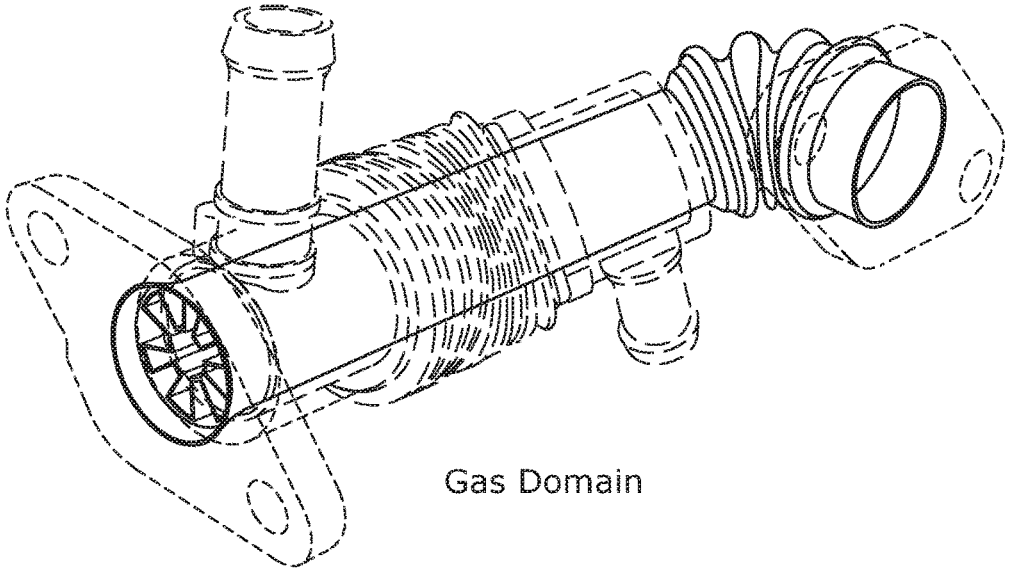
FIG. 4 shows schematically the first cooler in perspective view showing a gas domain of the first cooler.

Referring to FIG. 4 herein, there is shown in perspective view the first embodiment cooler, showing a gas domain, being component parts and surfaces of the cooler which are in direct contact with the gas to be cooled, and to which heat is directly transferred by said gas. The gas domain comprises an inner surface of: the inner tubular parts of the first section 102, the first set of internal fins 111, the second set of internal fins; and an inner surface of the air cooled section 104.

Figure 5:
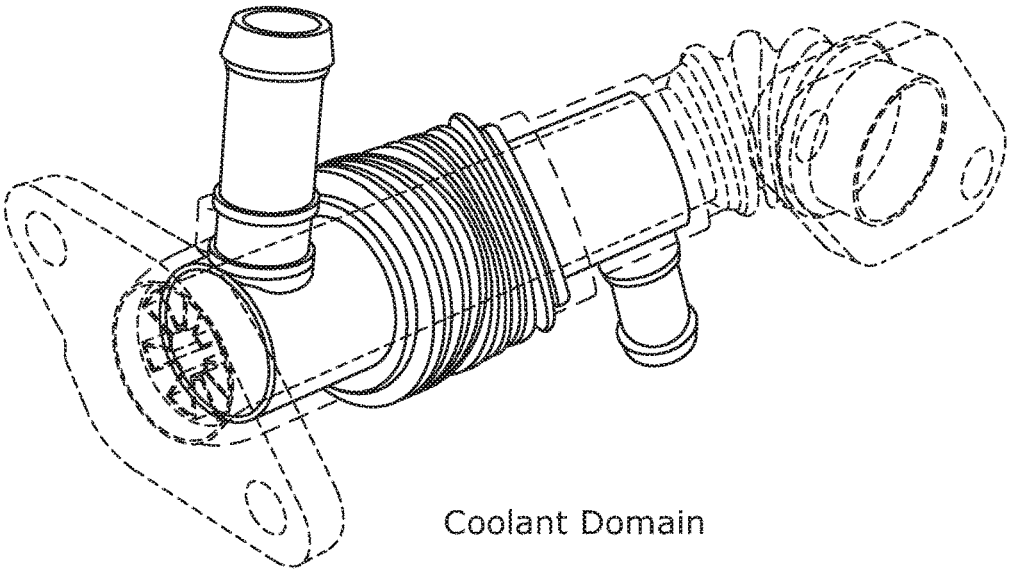
FIG. 5 shows schematically the first cooler in perspective view showing a coolant domain of the cooler.

Referring to FIG. 5 herein, there is shown a view of the first embodiment cooler which shows a coolant domain, being component parts and surfaces of the cooler which are in direct contact with the liquid coolant and to which heat is transferred from the component parts to the liquid coolant. The coolant domain comprises inner surfaces of: the outer jacket comprising first outer straight tube 103, outer corrugated tube 112, and second outer straight tube 113; outer surfaces of the first straight inner tube, the inner bent tube, and the second inner straight tube, the coolant outlet tube 110 and the coolant inlet tube 114. The coolant domain comprises the whole of the internal cavity in the straight sections and corrugated section of the first section 102 together with the coolant inlet tube and the coolant outlet tube.

As seen in FIG. 5, along the length of the cooler the coolant domain extends in parallel with the gas domain over part of the length of the gas domain, whereas the gas domain extends over substantially the entire length of the coolant domain. The gas domain runs centrally through the coolant domain.

Internal Fins

In the first embodiment cooler, the internal fins each comprise a substantially radially extending wall extending between an inner wall of the substantially straight inner tube and a position near the centre of the gas passage through the inner tube. The walls extend axially along a length of the inner tube, and project inwardly into the central gas passage.

A plurality of said internal fins may be provided as part of a fin member. Each fin member comprises a plurality of substantially radially extending walls joined together at their radially outermost positions by a plurality of substantially arced cylindrical walls.

In a conventional tubular gas to liquid heat exchanger, having passage of a gas through a tubular member, heat exchange occurs only on the inner facing wall of the tubular member, this being the only place where gas comes into contact with the material of the tubular member. However, by providing a plurality of fins as described herein, this provides further heat exchange surfaces which the gas may come into contact with. Heat transferred from the gas to the fins passes by conduction along the material of the fin, heating up the whole fin and reaches a position where the fin contacts the inner wall of the tubular member. Heat is transferred by conduction from the fin member to the inner wall of the tubular member, through the material of the tubular member, and to the coolant on the other side of the tubular member, where the outer surface of the tubular member comes into contact with the liquid coolant.

Hence, the overall surface area in the central passage of the tubular heat exchange member which comes into contact with the gas flow and through which heat can be exchanged between the material of the heat exchanger and the gas is increased by provision of the fins in the heat exchange tube.

Figure 6:
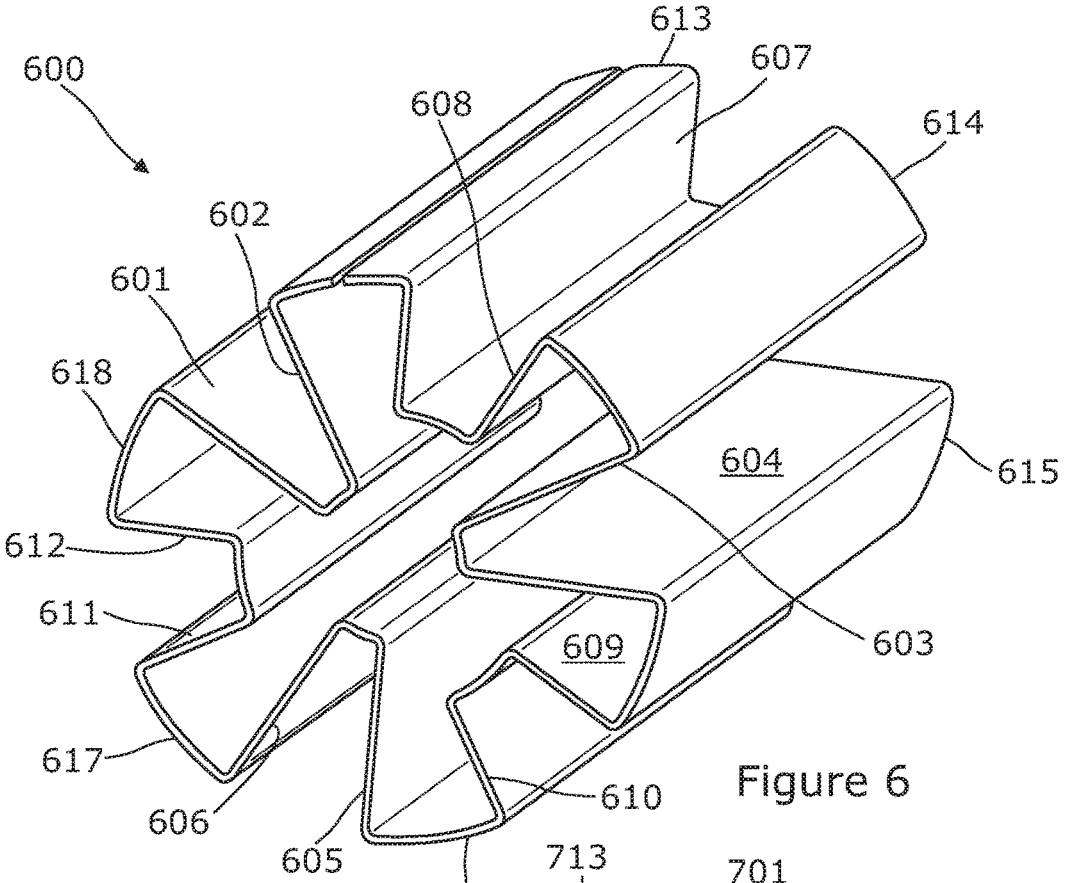
FIG. 6 herein shows schematically a first fin assembly according to a first embodiment fin assembly.

Referring to FIG. 6 herein, there is shown in perspective view a first fin assembly 600. The fin assembly is shown in its condition when inserted into the heat exchange tube. Prior to insertion the fin assembly is more open, (see FIGS. 15 and 16 herein). The first fin assembly is formed from a single strip of initially flat metal having a smooth surface on both sides. The strip is formed into a fin member which is shaped to fit into a circular cylindrical outer boundary (for example an inner surface of a circular cylindrical heat exchange tube). The first fin assembly comprises a plurality of substantially radially inwardly extending longer first fin walls 601-606; a plurality of substantially radially inwardly extending shorter second fin walls 607-612; a plurality of part circular cylindrical or arced outer connecting walls 613-618; a plurality of part circular cylindrical first inner connecting walls 619-621 each of which connects together the radially inward lower ends of a pair of adjacent first fin walls; and a plurality of part circular cylindrical second inner connecting walls 622-624 each of which connects together the radially inward lower ends of a pair of adjacent second fin walls.

Figure 7:
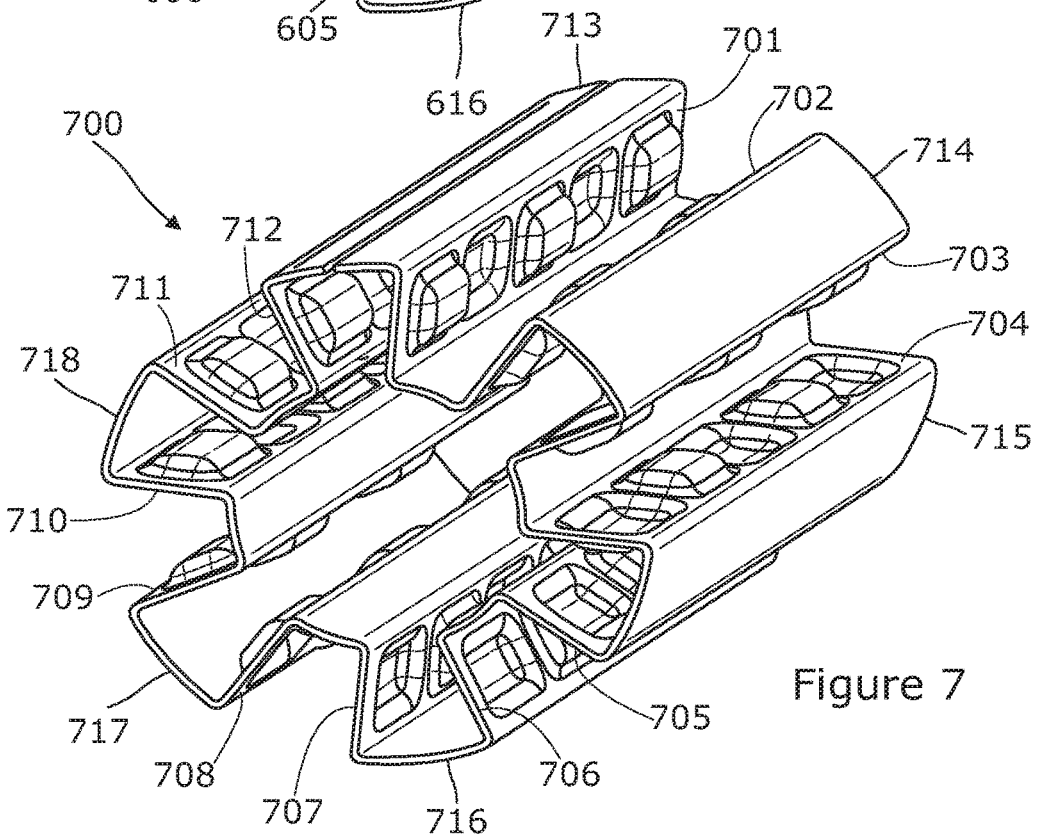
FIG. 7 herein shows a second fin assembly according to a second embodiment fin assembly.
Figure 9:
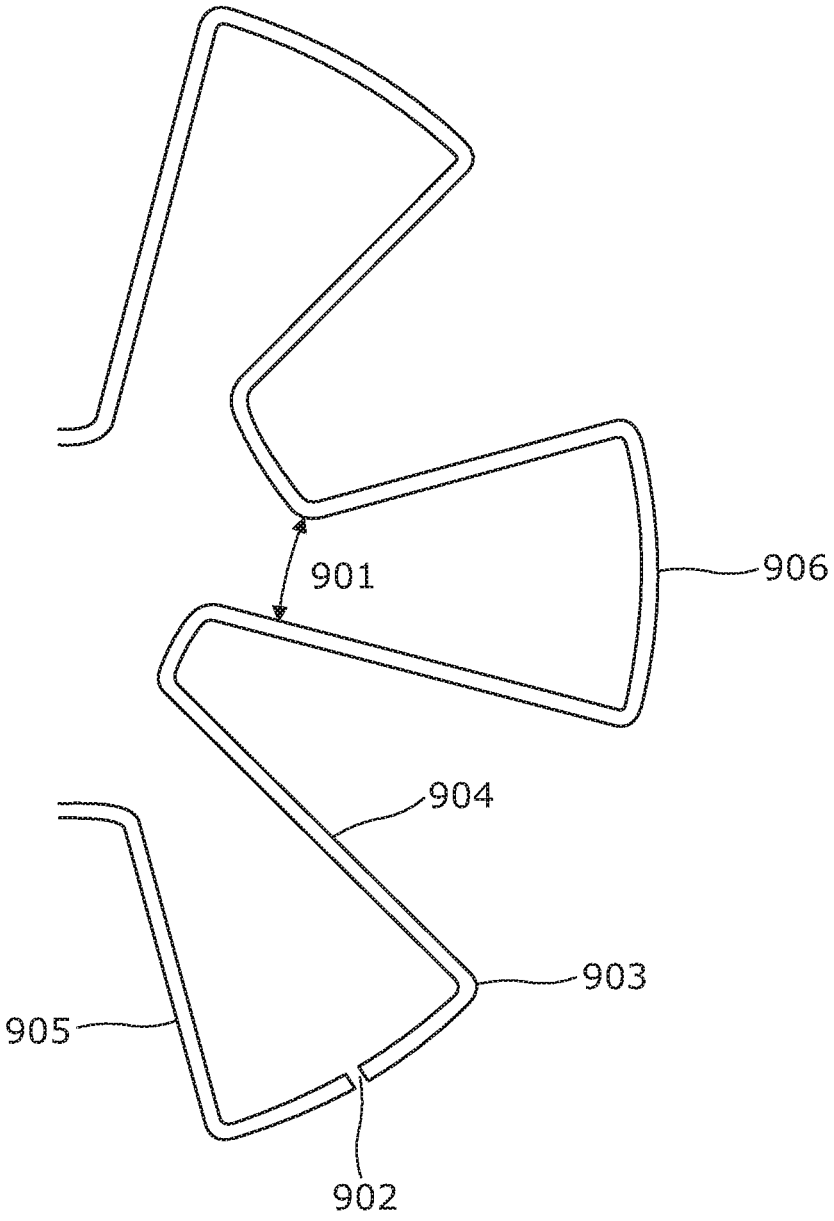
FIG. 9 shows part of the first fin assembly viewed from its end.

FIGS. 6, 7 and 9 show the inner connecting walls to form parts of a circle. For ease of manufacture FIG. 9 shows the inner connecting walls to be a radius between the fin walls.

The inwardly facing surfaces of the first inner connecting walls, facing inwardly towards the central axis of the fin member, lie substantially on a first circular cylinder. The inwardly facing surfaces of the second inner connecting walls, facing inwardly to a central axis of the fin member, lie substantially on a second circular cylinder. The inwardly facing surfaces of the second inner connecting walls lie radially inwardly relative to the inwardly facing surfaces of the first inner connecting walls, so that the plurality of first fin walls extend radially further inwards from an outer circumference of the fin member compared to the plurality of second fin walls.

The fin member is manufactured from a single elongate substantially flat smooth sided piece of metal which is formed into the substantially flower shaped cross-sectional form as shown in FIG. 6. The single elongate strip of metal is folded such that a first end and a second end of the metal strip form a first outer connecting wall 613. The fin member is formed such that the outside diameter of the component in an unrestrained state, where the fin member is not inserted into a heat exchange tube is larger than the outside diameter of the component in a constrained state when the component is fitted inside a heat exchange tube. The fin when fitted inside the heat exchange tube does not form a full 360° as shown by connecting wall 613. There is a small gap between the two ends of the material to allow for ease of insertion and tolerances.

The fin member may be formed of a resilient metal material, such that once formed, it has a resilience and a tendency to expand into its as—formed shape, such that when fitted inside a heat exchange tube and therefore compressed to a slightly smaller diameter circular cylinder, the the outer circumferential surfaces 613-618 of fin member contact with, and are urged radially outwardly against, the inner circular cylindrical surface of a heat exchange tube, thereby ensuring good thermal contact between the fin member and the wall of the heat exchange tube.

In order to fit the fin member into a substantially straight circular cylindrical heat exchange tube, the fin member will be compressed from its more open form to the diameter of the heat exchange tube and then may be slightly compressed in the circumferential direction, slid into the inside of the heat exchange tube, and released. The resilience of the metal material of the fin member causes the fin to expand outwards on to the heat exchange tube diameter and retain itself by friction inside the heat exchange tube. However, as a further stage of manufacture, the circumferentially extending faces 613-618 may be brazed, welded or soldered to the inner facing wall of the heat exchange tube, either at the axial ends of the fin member, and/or along the edges between the first radially extending fins 601-607 and a corresponding respective outer circumferential surface 613-618.

Having alternate pairs of relatively longer and relatively shorter radially extending fins prevents adjacent pairs of fins being located in too close proximity to each other, and thereby minimizes the effect of resistance to gas flow, thereby minimizing the effect of pressure drop and improving heat exchange, and minimizes the incidence of the inward tips or edges of the fins and the inner circumferential extending surfaces becoming clogged with exhaust gas solid/liquid pollutants.

In the case of the first fin assembly, there are provided a first plurality of gas passages between the fin assembly and the inner walls of the heat exchange tube which extend in a circumference around the second circular cylinder. A central gas passage is formed in a substantially flower petal shape when viewed along a main axis of the heat exchange tube, said central gas passage comprising a substantially circular cylindrical central passage having a plurality of radially extending segments arranged around said substantially circular cylindrical central passage.

Referring to FIG. 7 herein, there is illustrated schematically in perspective view a second fin assembly 700. The second fin assembly is manufactured from a single strip of initially flat metal having a smooth surface on both sides. The fin member is shaped to fit into a circular cylindrical outer boundary, for example an inner surface of a circular cylindrical heat exchange tube. The second fin assembly comprises a plurality of substantially radially inwardly extending fin walls 701-712; a plurality of part circular cylindrical outer connecting walls 713-718 extending in an outer circumference, each of which connects together the radially outer edges of a pair of adjacent first fin walls; a plurality of part circular cylindrical first inner connecting walls 719-721 extending in an inner circumference, each of which connects together the radially inward lower edges of a pair of adjacent first fin walls.

The inwardly facing surfaces of the inner connecting walls 719-721, face inwardly towards a main central axis of the fin member and lie substantially on a first circular cylinder. The outer surfaces of the outer connecting walls 713-718 face outwardly radially away from the main central axis and lie on a second outer circular cylinder. In use, these outer surfaces are in contact with the inner surface of the central heat exchange tube so that heat can exchange between the fin member and the wall of the inner heat exchange tube.

Along the axial length of each fin, the fin wall is formed into a plurality of protruding dimples or mounds which protrude circumferentially into the gas flow between adjacent fins. Each fin wall comprises alternating dimples formed successively to one side and then to another of the main plane of the fin wall, so that as gas flows along the passage bounded by the thin walls, the dimples or mounds cause turbulent gas flow within the passages. In the embodiment shown, the dimples are substantially square shaped frusto—pyramids, but in other embodiments the dimples may be hemispherical, semi ovoid, frusto—conical, or elongate ridges/troughs. Provision of the protrusions has the effect of providing additional resistance to gas flow, and therefore has the penalty of increasing the gas pressure drop through the fin member, but has an advantage of increasing turbulence in the gas flow, and increasing the surface area of the fin per unit length of the fin member which comes into contact with the gas and therefore enhances heat transfer rate per unit length of fin member.

The second fin member is manufactured from a single elongate substantially smooth sided piece of metal which is initially flat and is formed into the substantially flower shaped cross-sectional form as shown in FIG. 7. The single elongate strip of metal is stamped or pressed to form the plurality of dimples or mounds, and is folded such that a first end and a second end of the metal strip form a first outer connecting wall 713. The fin member is formed such that the outside diameter of the component in an unrestrained state, where the fin member is not inserted into a heat exchange tube is slightly larger than the outside diameter of the component in a constrained state when the component is fitted inside a heat exchange tube. The difference in diameter between the unrestrained and restrained conditions is accommodated by virtue of the two ends of the metal strip forming the first outer circumferential wall part 713 not overlapping each other and being slidable with respect to each other over a circumferential distance less than the circumferential distance of the outer circumferential wall portion.

The fin member may be formed of a resilient metal material, such that once formed it has a resilience and a tendency to expand into its as—formed shape, such that when fitted inside a heat exchange tube and therefore compressed to a slightly smaller diameter circular cylinder, such that the outer circumferential surfaces 713-718 contact and are urged radially outwardly against the inner circular cylindrical surface of a heat exchange tube, thereby ensuring good thermal contact between the fin member and the wall of the heat exchange tube.

In order to fit the fin member into a substantially straight circular cylindrical heat exchange tube, the fin member may be slightly compressed in the circumferential direction, slid into the inside of the heat exchange tube, and released. The resilience of the metal material of the fin member causes the fin to retain itself by friction inside the heat exchange tube.

The second fin assembly may be inserted inside a heat exchange tube and retained inside the heat exchange tube either by friction, or by welding, brazing or soldering similarly as described herein before with reference to the first fin assembly.

Each of the first and second fin assemblies described hereinabove, when manufactured and unrestrained may form a first arc of less than 360°. When the first and/or second fin assembly is inserted into a heat exchange tube, the assembly may be compressed such that it extends over a greater angle of arc than in its uncompressed state. In the installed state the fin will extend over an angle of just under 360°.

The second fin assembly provides a plurality of radially extending elongate passages along a main length of the heat exchange tube, each said passage having a substantially truncated segment shape having an outer arcuate wall and an inner arcuate wall, said elongate passages being provided between the fin member and the inner wall of the heat exchange tube. There is also provided a central gas passage comprising a central circular cylindrical passage and a plurality of radially and circumferentially extending second passages, being substantially segment shaped in cross-section, wherein the second segment shaped portions alternate with the first set of substantially truncated segment shaped passages. The plurality of radially extending first elongate passages are separated from the main central passage by the fin walls. On passing through the second fin member, a single flow of gas is divided into a plurality of parallel gas passages by the fin member, and once passed through the fin member, the gas flow re-converges into a single gas flow.

In each of the first and second fin assemblies described herein, the fin assembly provides a plurality of fin walls which extend inwardly from an inner surface of said inner heat exchange tube towards a main central axis of said heat exchange tube, and which form a plurality of axially extending gas passages which occupy a substantially annular region in a direction perpendicular to said main central axis of said heat exchange tube.

Figure 8:
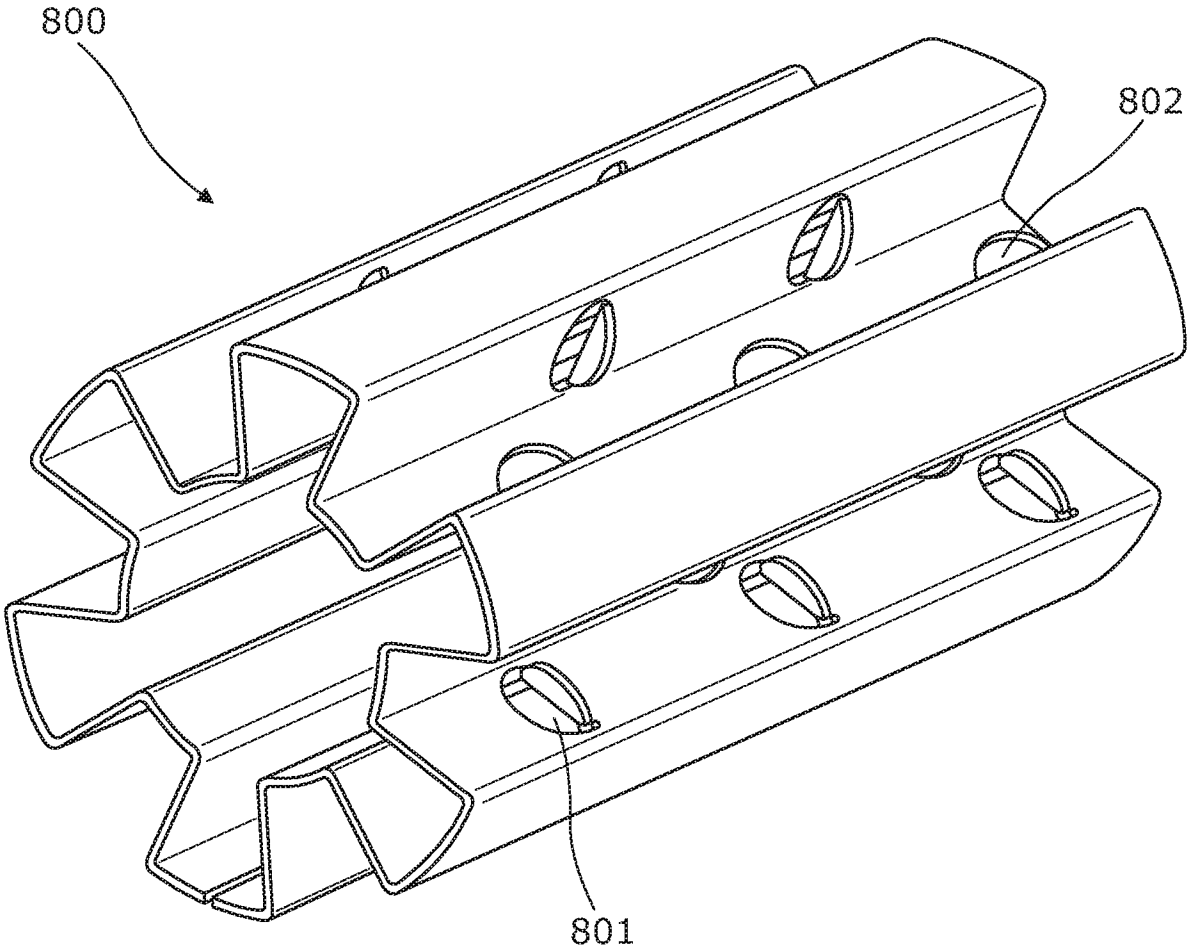
FIG. 8 herein shows a third fin assembly according to a third specific embodiment fin assembly.

Referring to FIG. 8 herein, there is illustrated schematically a third fin assembly 800 also suitable for use in the first embodiment cooler herein. The third fin assembly comprises of the same basic form as FIG. 7. Instead of the dimples being formed into the fin material, the material is pierced on one side, so as to form a plurality of semicircular apertures 801 in the fin walls, and semicircular projections 802 extending into the gas flow path. This opens a path for flow of some gas from an outer gas passage into the inner petal shaped gas passage and from the inner petal shaped gas passage to the adjacent outer gas passages.

Referring to FIG. 9 herein there is illustrated schematically in view from one end along an axial direction, part of a fin assembly in its installed condition. In this installed condition, a minimum distance 901 between any two adjacent fin surfaces is preferably 1.5 mm or greater. Gaps smaller than this tend to cause excessively low gas velocities reducing heat exchange and increasing the likelihood of clogging of exhaust material between the fins.

A gap 902 between the two ends of the formed fin assembly is required. If the two ends touched or over lapped when the fin assembly was in its installed condition, part of the fin assembly may not have the correct contact with the heat exchange tube. The gap does not affect heat exchange. Heat conducted from the fin to the heat exchange tube is transferred at or near the interface 903 at the transition between the substantially radially extending fin walls 904, 905 and the arced perimeter portions 906. The fin assembly in its as manufactured state tends to have a greater external radius than the internal radius of the heat exchange tube into which it is designed to fit and needs to be compressed slightly in order to fit inside the heat exchange tube. The resilience of the material of which the fin assembly is made cause fin assembly to press against inner surface of the heat exchange tube when fitted therein.

Figure 10A:
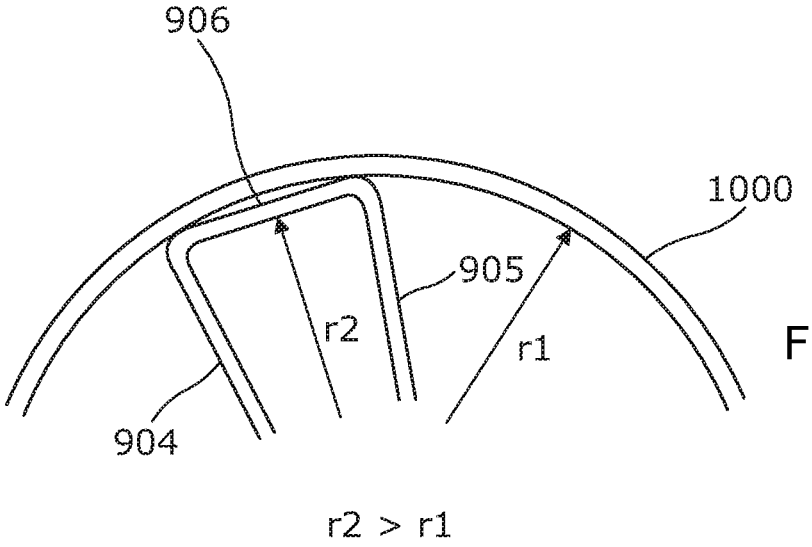
FIG. 10A shows part of the fin assembly of FIG. 9, and part of a heat exchange tube, showing contact points between the fin assembly and the heat exchange tube.

Referring to FIG. 10A herein, a pair of fin walls 904 and 905 and an outer fin connecting length 906 are shown in the fin—installed condition inside a heat exchange tube 1000. The fin set contacts with the heat exchange tube 1000 in a region near the bend between the substantially radially extending fin walls and the arc-shaped connecting portions between the fin walls. It can be seen that radius r1 of the heat exchange tube is smaller than the radius r2 of the arced outer surface of the connecting portion 906, as measured from the axial centre of the fin assembly. This ensures that the fin assembly contacts the heat exchange tube as near to the end of the fin walls as possible.

The difference in radii r1 and r2 should not be so great as to cause an excessive gap between the outer fin connecting portion 906 and the heat exchange tube. An excessive gap in this region would cause loss of heat exchange.

Figure 10B:
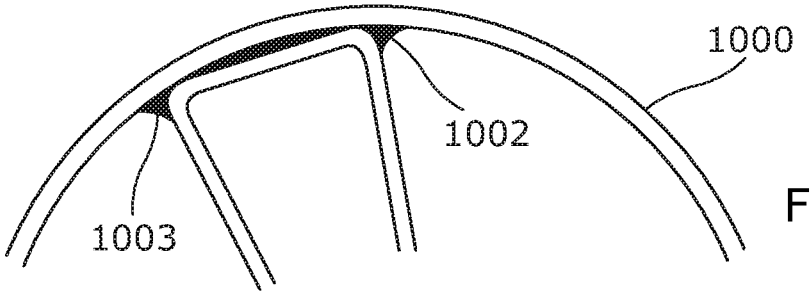
FIG. 10B shows part of the fin assembly and heat exchange tube of FIG. 10A, having brazed connection between the fin assembly and the heat exchange tube, illustrating how a joint having good thermal transfer characteristics is achieved.

Referring to FIG. 10B herein, when the fin is soldered or brazed to the heat exchange tube, a meniscus 1101 and 1102 is formed on either side of the contact points between the fin assembly and the inside surface of the inner heat exchange tube. This meniscus ensures the best path for heat conduction. The braze will also fill the gap between the arced outer fin connecting length 906 and the heat exchange tube 1000, as shown in FIG. 10B further improving heat exchange.

Figure 10C:
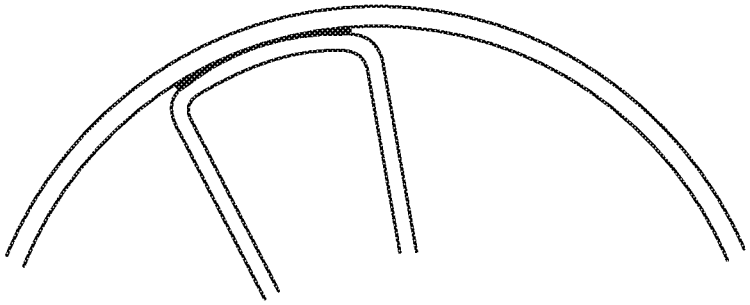
FIG. 10C shows schematically a joint between a fin assembly and the heat exchange tube, which has a non-optimal heat transfer characteristics.

As shown schematically in FIG. 10C herein, if r1 is greater than r2 then the centre of the outer fin connecting portion 906 will contact the heat exchange tube. Even when brazed, the meniscus may not fill the gap between the outer surface of the arced connecting part of the fin assembly and the inner facing surface of the inner tube. This effectively increases the length of the fin wall and reduces heat exchange occurring through conduction between the fin assembly and the inner tube, leading to a less effective heat transfer than where the radially outermost ends of the fin walls contact the inner surface of the heat exchange tube, and are connected by brazing as shown in FIG. 10B herein.

Figure 11:
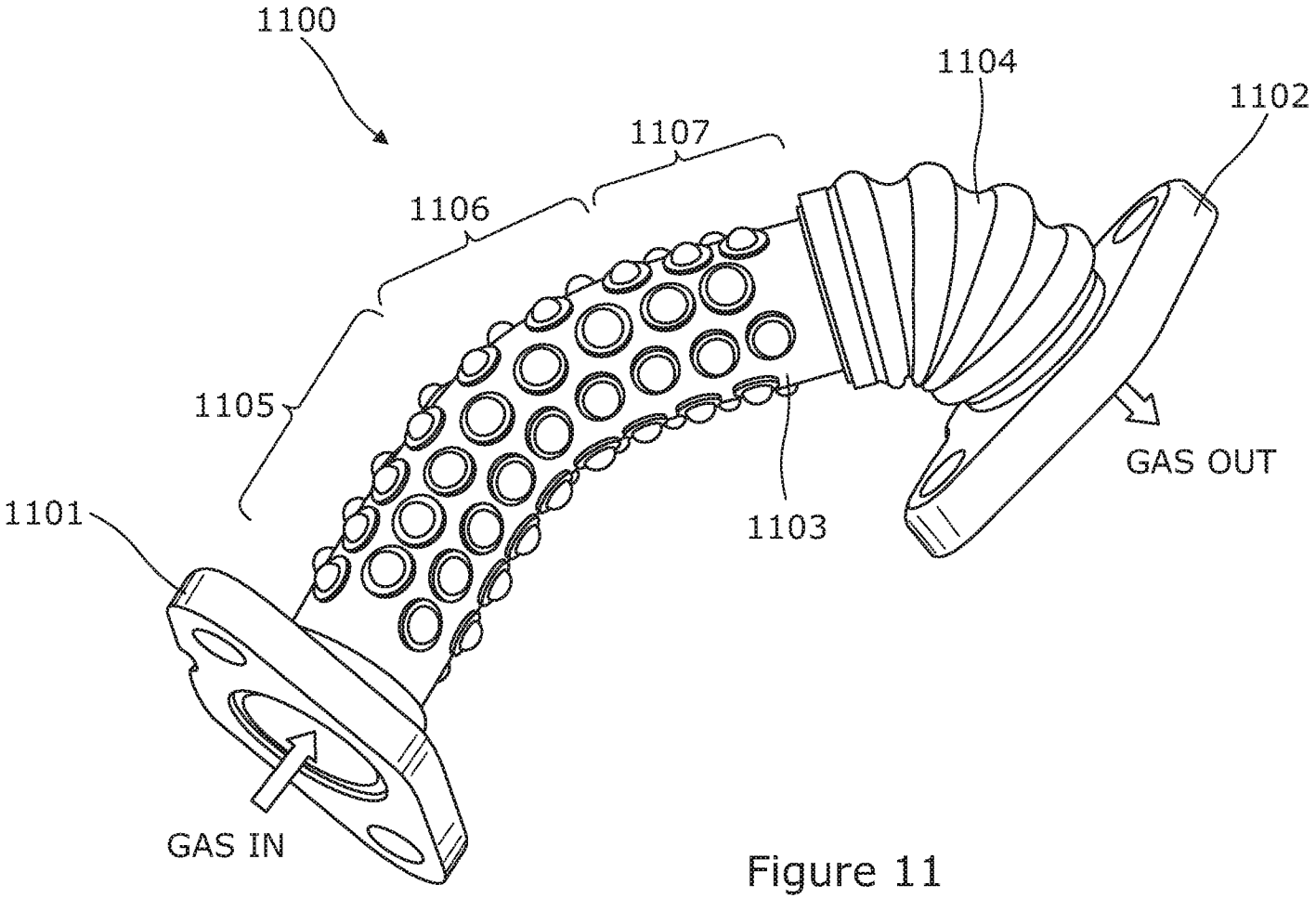
FIG. 11 herein illustrates schematically part of a second cooler device according to a second specific embodiment heat exchanger.

Referring to FIG. 11 herein, there is illustrated schematically part of a second heat exchanger device 1100 showing an internal heat exchange tube 1103 according to a further embodiment heat exchanger. The heat exchanger of FIG. 11 comprises a first flange 1101 at a first end of the heat exchanger; a second flange 1102 at a second end of the heat exchanger; an inner heat exchange tube 1103 extending between the first and second ends; and a corrugated end tube 1104 extending between one end of the inner heat exchange tube 1103 and the second flange 1102. The heat exchanger of FIG. 11 also comprises first and second outer substantially straight jacket sections and a central corrugated outer jacket section surrounding the inner heat exchange tube 1103, similarly as described with respect to the first cooler embodiment of FIGS. 1 to 5 herein. The second heat exchanger also has a coolant inlet tube and a coolant outlet tube. The tube may be fitted with a set of internal fins as described with reference to FIGS. 1 to 8 herein. Preferably, the fins will be attached to a smooth section and the dimples shown in FIG. 11 will be in a non finned area. Preferably, the internal fins occupy straight sections of the inner heat exchange tube. The outer jacket, internal fins, and coolant inlet and outlet tubes are omitted from FIG. 11 in order to show in more detail the structure of the internal heat exchange tube 1103.

The heat exchange tube 1103 comprises a single tubular metal member having a first substantially straight portion 1105; a curved or angled portion 1106; and a second substantially straight portion 1107. An end of the second substantially straight portion 1107 is connected to a first end of the corrugated end tube 1104. The entire heat exchange tube comprising the first and second straight sections 1105, 1107 and the curved section 1106 is in use surrounded by liquid coolant which is encased in a cavity between the heat exchange tube 1103 and first and second outer straight tubular sections and an outer corrugated section.

The tubular wall of the heat exchange tube is formed with a plurality of outwardly projecting mounds or dimples which project into the cavity in which the liquid coolant flows. The projecting dimples or mounds on the outside of the heat exchange tube correspond with respective recesses on the otherwise smooth internal heat exchange tube wall on the inside of the tube. The projections provide a relatively increased surface area for heat transfer between the gas on one side of the surface, and the liquid coolant on the other side of the surface, compared to a straight circular cylindrical tube.

The effect of the dimples on the heat exchange tube was found to cause only a low increase in the turbulence of the exhaust gas. The dimples can be used on the straight portions of the heat exchange only, on the curved portion of the heat exchange tube only, or on both the straight and the curved portion.

Figure 12:
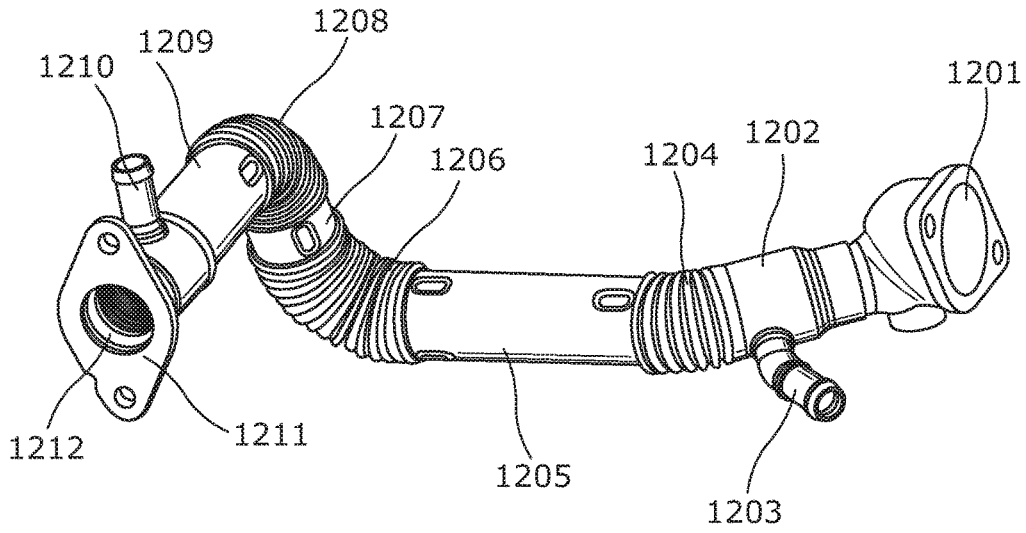
FIG. 12 shows a third cooler device according to a third specific embodiment heat exchanger, having three bends.

Referring to FIG. 12 herein there is shown a third co-axial cooler according to a third embodiment heat exchanger, having three bends and four straights. The cooler consists of a gas inlet boss 1201 a straight section 1202 with a coolant connection tube 1203, a first corrugated section 1204, a second straight section 1205, a second corrugated section 1206, a third straight section 1207 a third corrugated section 1208, a fourth section 1209 with a second coolant connection 1210 and a flange 1211. Inside the cooler is a heat exchange tube 1212 and (not shown in FIG. 12) a number of fins.

Corrugated sections 1204, 1206 and 1208 each have a small straight section either side of a bent section.

The heat exchange tube 1212 has a dimpled section (as illustrated in FIG. 11 herein) in the length inside the first straight section 1202. In this section there are no fins, this reduces heat exchange at the gas inlet and aids the reduction of localized boiling of coolant in the outer jacket surrounding the first straight section. The heat exchange tube 1212 inside the first corrugated section 1204 is also corrugated and has no fin. The heat exchange tube inside second straight section 1205 has a smooth surface and a fin brazed to it over at least part of its length. At both ends of the second straight section 1205, the tube has a single line of dimples. The heat exchange tube 1212 under the corrugated section 1206 is also corrugated and has no fin. The heat exchange tube 1212 inside the straight section 1207 has a dimpled section and no fin. The heat exchange tube 1212 inside the third corrugated section 1208 is also corrugated and has no fin. The heat exchange tube 1212 inside fourth straight section 1209 has a smooth surface and a fin brazed to it over at least part of its length. At the end of the fourth straight section adjacent to the third corrugated section 1208, the heat exchange tube has a single line of dimples. Thus the heat exchange tube is made of sections of smooth tubing with fins attached, a short length of tube either side of the finned area with dimples, straight sections with dimples without fins and a corrugated section without fins.

It is apparent to one skilled in the art that the gas could flow in the opposite direction entering the cooler at the flange 1211. This may be a preferred gas flow regime if there was a concern with boiling at the corrugated bend. The first finned section within the fourth straight section 1209 would have already substantially cooled the gas prior to the bend 1208 in the third corrugated section. All designs will be variations and dependant on the required cooling application and boundary conditions.

Figure 13:
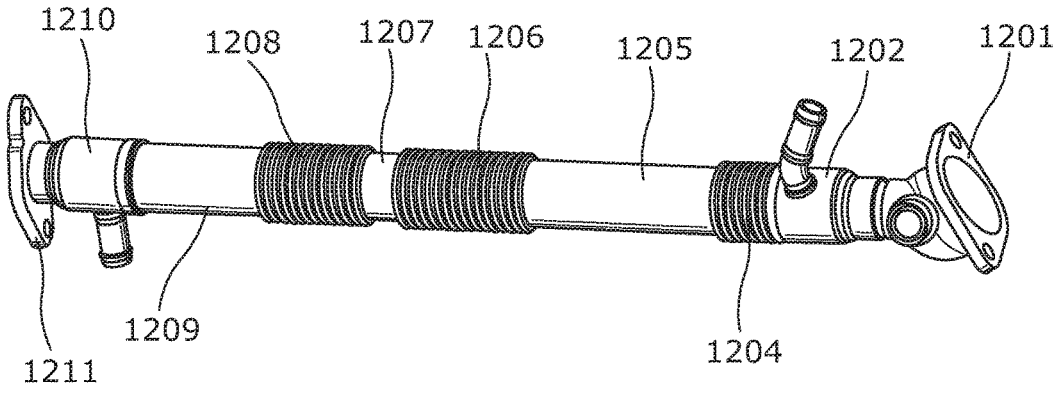
FIG. 13 shows the third cooler of FIG. 12 in its pre-bent condition during a stage of manufacture.

Referring to FIG. 13 herein, the third cooler is shown assembled in its straight condition. Fins are brazed to the heat exchange tube in the second and fourth straight section regions 1205 and 1207. There are dimples on the heat exchange tube in the second, third and fourth straight regions 1205, 1207, 1209. The outer diameter formed by the crest of the dimples is nominally at the same diameter as the internal diameter of the outer tube. Tolerancing is set to enable assembly.

Once assembled the first corrugation at 1204 is bent. This action causes both the outer tube and the inner heat exchange tube to bend together. The assembly is then bent at the second corrugated section 1206 and finally at the third corrugated section 1208. By virtue of the dimples' outer diameter being nominally the same diameter as the inner diameter of the outer tube the heat exchange tube is maintained in a substantially concentric condition during bending.

Figure 14:
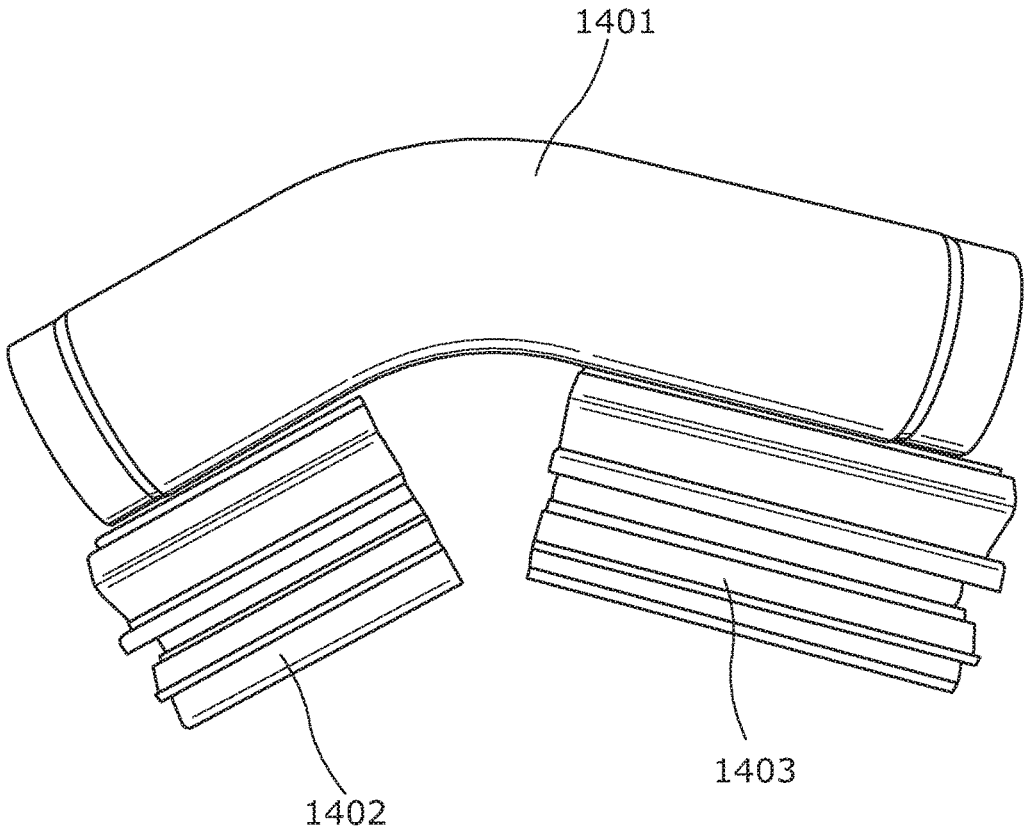
FIG. 14 shows the heat exchange tube of the first cooler with the two fin sets placed next to their straight sections of the heat exchange tube.

Referring to FIG. 14 herein there is shown an inner tube 1401 of the first embodiment heat exchanger tube 1401 and two sets of fins 1402 and 1403 from the heat exchanger shown in FIG. 1.

Figure 15:
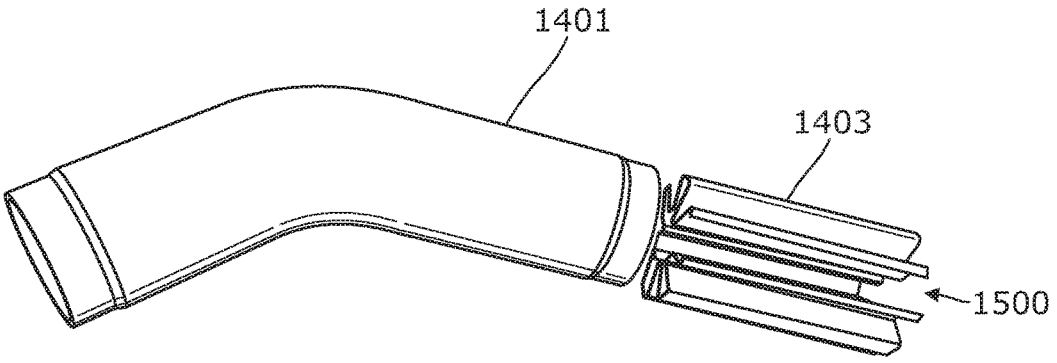
FIG. 15 shows the heat exchange tube for the first cooler with one of the fin sets in its manufactured condition prior to insertion in the heat exchange tube.

Referring to FIG. 15 herein there is shown the heat exchange tube 1401 and one fin set 1403 in its as—manufactured condition. It can be seen that there is a substantial width gap 1500 between the ends of the fin form.

The diameter of the fin in this condition is greater than the internal diameter of the heat exchange tube 1401.

Figure 16:
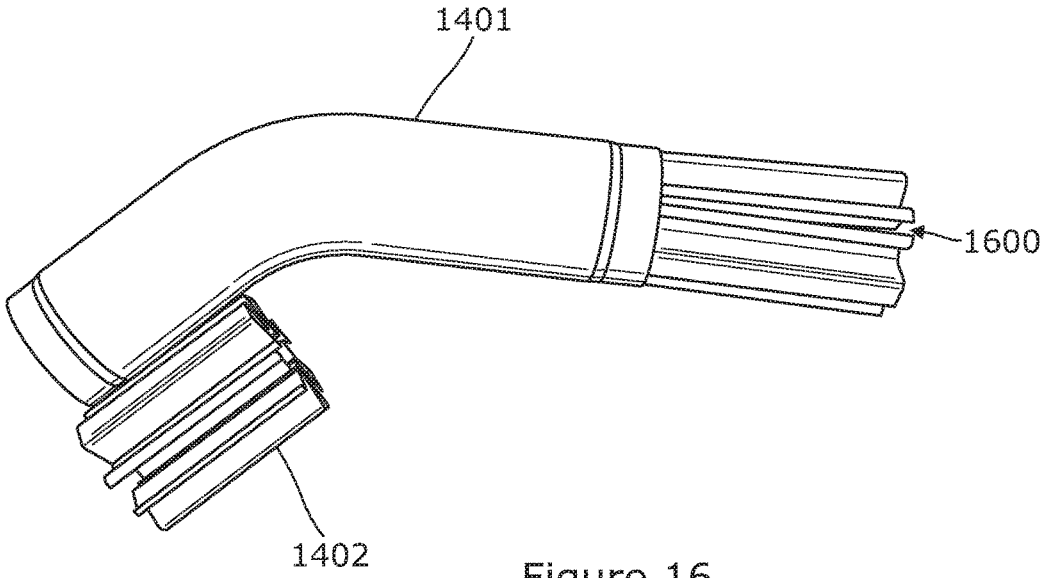
FIG. 16 shows the heat exchange tube for the first cooler with one of the fin sets partially inserted therein.

Referring to FIG. 16 herein there is shown one of the fin sets 1403 partially inserted into the heat exchange tube 1401. The gap 1600 between the ends of the fin form can now been seen to be substantially smaller than the gap 1500 in the fin set's unconstrained state. The fin set 1403 is now compressed and the elasticity of the material tries to open the fin set outwards. This ensures that close contact is maintained between the fin and heat exchange tube.

Fin Materials

In various embodiments, the internal fin members may be constructed of ferritic stainless steel. Ferritic stainless steel has a significantly higher thermal conductivity than 300 series stainless steel and was found to give a reduced gas out temperature of 18° C. lower than the corresponding gas out temperature using equivalent fins made of stainless steel 321. The use of ferretic stainless steel fins compared to using stainless steel 321 reduced the gas out temperature by up to 18° C. under equivalent operating conditions.

The fins may be manufactured from 309, 310 or Inconel.

Effect of Relative Flow Direction

The embodiment coolers herein can be connected in circuit so that the gas flow and liquid coolant flow can be changed so that the gas coolant are in contra flow (in the opposite direction to each other), or in parallel flow (in the same direction as each other). Computer modelling tests found that by connecting the gas flow and liquid coolant flow in parallel a significant reduction in the boiling index could be achieved, without any significant difference in rate of heat exchange. Therefore, in some applications, connection of the gas flow and liquid coolant flow in parallel may be preferred.

Other Variations

In various embodiments disclosed herein, and variations thereof within the scope of this disclosure, a coaxial cooler having a heat transfer tube, comprises at least in part, one or more straight sections having a plain or smooth surface. The plain surface ensures good coolant flow over the heat exchange surface. Eddies of low coolant flow present in the roots of the corrugations may be eliminated, and boiling may thereby be very significantly reduced. Further, as the heat exchange surfaces may be plain or smooth, the drag caused by those surfaces on passing gas may be much reduced, and so gas pressure drop may be significantly reduced in comparison to a conventional corrugated heat exchange tube.

In general, providing a smooth heat exchange surface reduces turbulence, but also reduces heat exchange. To achieve a relatively high heat exchange per unit length, a plurality of fins are joined to an inner surface of a heat exchange tube. The heat transfer tube may be a plain or smooth surface over its whole length, including any bends in the tube.

Alternatively, the heat exchange tube may have corrugations on the bend portion, or on a section of the straight portion, or on both. The corrugations may be either annular or helical. The corrugated section may have a varying pitch, which improves performance of the heat exchanger, or facilitates improved assembly of the heat exchanger.

Adapter tubes for the coolant inlet and outlet which join the main heat exchanger body may be pressed, cast, machined, sintered or 3-D printed in order to minimise their size. For cost reasons, the adapters may be formed.

These exchangers may operate with the gas flow in contraflow to the liquid coolant, or with the gas flow coincident or parallel with the liquid coolant flow.

An outer tube which is positioned around a central heat exchange tube may be partially corrugated or may be plain and smooth. Where corrugated, the corrugations may be either annular or helical. The corrugated section may comprise a varying pitch along its length, to improve performance, or to improve assembly.

The fin components may be made of austenitic or ferritic stainless steel. Ferritic stainless steel has a high thermal conductivity which may make the fins more effective for heat transfer. For very high temperature applications, an Inconel fin may be used.

The fins may be attached to the inside of the heat exchange tube by a brazing process or by a welding process. The fins may be formed in a rolled strip forming an arc between 0° and 350°. The natural resilience of the strip material when inserted into the inside of a heat exchange tube increases the angle of the arc, pushing the fin out to contact the heat exchange tube surface.

Successive fins may be of the same length or differing lengths. Where fins are all of the same length, then as the fins extend towards the centre of the tube, the gap between the fins may become small, causing increased drag on gases passing in the vicinity of those parts of the fin, leading to low velocities and relatively poor heat exchange. To ensure that the fins are as efficient as possible, the fins may be attached to the heat exchange tube as near to right angles to the inner circular cylindrical surface of the tube as possible. This can be achieved by having a sharp radius of curvature on the fin on the transition from the circumferential part of the fin to the radially extending part of the fin which extends radially into the heat exchange tube. Having a good braze meniscus on the joint between the fin and the heat exchange tube also helps to achieve high heat transfer efficiency between the fin and the tube.

There may be between 1 and 30 individual radially extending fins inside the inner tube. The cooler may optimally have a heat exchange tube inner diameter of between 5 mm and 50 mm in preferred embodiments.

Any of the individual fins structures and fin assemblies disclosed herein may be used with any one of the heat exchanger embodiments disclosed herein in any combination.

Dimples formed outward from the heat exchange tube may be used to improve heat exchange and to centre the heat exchange tube inside the outer tube. The dimples aid concentricity of the inner tube to the outer casing or tube, especially when a cooler has more than one bend.

The invention claimed is:

1. A heat exchanger for cooling a hot gas using a liquid coolant, said heat exchanger comprising:

an inner heat exchange tube adapted for exchanging heat between said gas and said liquid coolant;

a tubular outer body surrounding at least part of said inner heat exchange tube, wherein said heat exchanger is configured to enable said gas to flow through said inner heat exchange tube and said liquid coolant to flow between said inner heat exchange tube and said tubular outer body; and a single fin component, said single fin component comprising:

one or more fins of a first fin type being in contact with an inner surface of said inner heat exchange tube; and one or more fins of a second fin type also being in contact with said inner surface of said inner heat exchange tube, said one or more fins of the first fin type having a first length that extends inwardly by a first distance toward the central axis of said heat exchanger, said one or more fins of the second fin type having a second length that extends inwardly by a second distance toward the central axis of said heat exchanger, such that the first length and the first distance are different in value from the second length and the second distance, said one or more fins of the first fin type and said one or more fins of the second fin type being integrated to form the single fin component, said single fin component being configured to be fitted inside said inner heat exchange tube, and said single fin component comprising a resilient metal having resilience such as to cause said single fin component, upon insertion into said inner heat exchange tube, to expand outwardly, to thereby retain itself by friction inside said inner heat exchange tube.

2. The heat exchanger as claimed in claim 1, wherein said inner heat exchange tube is straight over at least part of a length of said inner heat exchange tube.

3. The heat exchanger as claimed in claim 1, in which said one or more fins of the first fin type and said one or more fins of the second fin type each comprise a plurality of fin walls extending inwardly between said inner surface of said inner heat exchange tube and towards a center of a passage through said inner heat exchange tube.

4. The heat exchanger as claimed in claim 1, in which said one or more fins of the first fin type and said one or more fins of the second fin type each comprise a plurality of fin walls extending inwardly between said inner surface of said heat exchange tube and towards a center of a passage through said inner heat exchange tube, to form corresponding radially outermost extremities of said fin walls, wherein said plurality of fin walls are connected by a corresponding plurality of circumferentially extending walls connecting said corresponding radially outermost extremities of said fin walls.

5. The heat exchanger as claimed in claim 1, in which said one or more fins of the first fin type and said one or more fins of the second fin type each comprise a plurality of fin walls which extend inwardly from said inner surface of said inner heat exchange tube towards the central axis of said inner heat exchange tube.

6. The heat exchanger as claimed in claim 1, in which said one or more fins of the first fin type and said one or more fins of the second fin type each comprise a plurality of axially extending gas passages which occupy a substantially annular region in a direction perpendicular to the central axis of said inner heat exchange tube.

7. The heat exchanger as claimed in claim 1, wherein one or more of said fins comprises one or a plurality of protrusions extending in a circumferential direction of said heat exchanger.

8. The heat exchanger as claimed in claim 1, wherein said one or more fins of the first fin type and said one or more fins of the second fin type are arranged into a plurality of segments, each segment comprising at least one fin.

9. The heat exchanger as claimed in claim 1, wherein said one or more fins of the first fin type and said one or more fins of the second fin type comprise a strip of material formed into a plurality of fins having an overall arc having an angle of less than 360°, wherein said strip of material, when inserted into said inner heat exchange tube, increases said angle of said arc.

10. The heat exchanger as claimed in claim 9, wherein said arc of said fin in contact with the heat exchange tube has a radius greater than said inner heat exchange tube.

11. The heat exchanger as claimed in claim 1, comprising a compensation tube joined to the heat exchanger to accommodate thermal growth and manufacturing tolerances.

12. The heat exchanger as claimed in claim 1, comprising one or more substantially straight smooth sections alternating with one or more corrugated sections, wherein the straight sections have internal finned structures providing heat transfer surfaces which are aligned in an axial direction along the flow of gas.

13. The heat exchanger as claimed in claim 1, that has a plurality of straights and a plurality of bends.

14. The heat exchanger as claimed in claim 1, comprising a plurality of outwardly formed dimples on the inner gas tube that set the gas tube to be substantially concentric within a tubular outer body.

15. The heat exchanger as claimed in claim 1, wherein said one or more fins each comprise fin walls having surfaces that extend in a direction parallel to an axial direction of the heat exchanger, wherein said surfaces of said fin walls extend radially towards the main central axis of said tubular outer body in which said fin walls are located so as to provide a plurality of individual gas passages surrounding a central gas passage, wherein said central gas passage has its center coincident with the central axis of said heat exchanger.

16. The heat exchanger as claimed in claim 1, wherein said single component comprises a plurality of flower-petal-shaped undulations, so that a single central gas passage of said single component, when viewed in a cross-section relative to the direction in which gas is configured to flow through the heat exchanger, appears in the shape of a flower, said single central gas passage being surrounded by a plurality of peripheral gas passages between said single component and said inner surface of said inner heat exchange tube.

17. A heat exchanger for cooling hot gas using a liquid coolant, said heat exchanger comprising:

an inner heat exchange tube adapted for exchanging heat between a gas and a coolant;

a tubular outer body surrounding at least part of said inner heat exchange tube, wherein said heat exchanger is configured to enable said gas to flow through said inner heat exchange tube and said coolant to flow between said inner heat exchange tube and said tubular outer body; and a single fin member which fits inside said inner heat exchange tube, said fin member comprising:

a plurality of radially extending first walls each extending along an axial direction of at least a portion of said inner heat exchange tube, said first walls each having a first length that extends inwardly by a first distance towards the central axis of said inner heat exchange tube, and a plurality of radially extending second walls each extending along an axial direction of at least a portion of said inner heat exchange tube, said second walls each having a second length that extends inwardly by a second distance towards the central axis of said inner heat exchange tube, said first distance being different in value from said second distance, and a plurality of circumferentially extending connecting portions, each said connecting portion extending between and connecting an adjacent one of said radially extending first walls to an adjacent one of said radially extending second walls, wherein said fin member is of dimensions such as to fit within said inner heat exchange tube such that an outer surface of each said connecting portion is in contact with an inner surface of said inner heat exchange tube, wherein said fin member is formed from a single strip of resilient metal material having resilience, such as to wherein the resilience of said metal material causes said single fin member, upon insertion into said inner heat exchange tube, to expand outwardly, to thereby retain itself by friction inside said inner heat exchange tube.

18. The heat exchanger as claimed in claim 17, wherein one side of each said circumferentially extending connecting portion is in contact with a central gas flow passage and another side of each said circumferentially extending connecting portion is in contact with said inner wall of said inner heat exchange tube.

19. The heat exchanger as claimed in claim 15, wherein the heat exchanger is configured to enable said gas to flow along said central gas passage and along each of said plurality of individual gas passages surrounding said central gas passage.

20. The heat exchanger as claimed in claim 17, wherein said one or more fins each comprise fin walls having surfaces that extend in a direction parallel to an axial direction of the heat exchanger, wherein said surfaces of said fin walls extend radially towards the main central axis of said tubular outer body in which said fin walls are located so as to provide a plurality of individual gas passages surrounding a central gas passage, wherein said central gas passage has its center coincident with the central axis of said inner heat exchange tube.

21. The heat exchanger as claimed in claim 20, wherein the heat exchanger is configured to enable said gas to flow along said central gas passage and along each of said plurality of individual gas passages surrounding said central gas passage.

22. The heat exchanger as claimed in claim 17, wherein said fin member comprises a plurality of flower-petal-shaped undulations, so that a single central gas passage of said fin member, when viewed in a cross-section relative to the direction in which gas is configured to flow through the heat exchanger, appears in the shape of a flower, said single central gas passage being surrounded by a plurality of peripheral gas passages between said fin member and said inner surface of said inner heat exchange tube.

* * * * *